US011031735B2

(12) United States Patent
Tamai

(10) Patent No.: US 11,031,735 B2
(45) Date of Patent: Jun. 8, 2021

(54) ELECTRICAL CONNECTOR ASSEMBLY

(71) Applicant: Hirose Electric Co., Ltd, Kanagawa (JP)

(72) Inventor: Nobuhiro Tamai, Tokyo (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 6 days.

(21) Appl. No.: 16/563,708

(22) Filed: Sep. 6, 2019

(65) Prior Publication Data

US 2020/0083647 A1 Mar. 12, 2020

(30) Foreign Application Priority Data

Sep. 7, 2018 (JP) ..... JP2018-168012

(51) Int. Cl.

*H01R 13/6474* (2011.01)
*H01R 12/70* (2011.01)
*H01R 13/405* (2006.01)
*H01R 13/04* (2006.01)

(Continued)

(52) U.S. Cl.

CPC ..... *H01R 13/6474* (2013.01); *H01R 12/7082* (2013.01); *H01R 12/716* (2013.01); *H01R 13/04* (2013.01); *H01R 13/112* (2013.01); *H01R 13/405* (2013.01)

(58) Field of Classification Search

CPC ..... H01R 12/73; H01R 12/716; H01R 12/91; H01R 12/7082; H01R 12/712; H01R 13/28; H01R 13/518; H01R 12/721; H01R 13/05; H01R 13/26; H01R 13/6315; H01R 13/6471; H01R 13/6473; H01R 13/6474; H01R 13/648; H01R 13/655;

(Continued)

(56) References Cited

U.S. PATENT DOCUMENTS 7,086,903 B2 * 8/2006 Takada ..... H01R 4/028 439/628
7,976,316 B2 * 7/2011 Ohshida ..... H01R 12/714 439/74

(Continued)

FOREIGN PATENT DOCUMENTS

JP 6198712 B2 9/2017

*Primary Examiner* — Edwin A. Leon
*Assistant Examiner* — Matthew T Dzierzynski
(74) *Attorney, Agent, or Firm* — Procopio, Cory, Hargreaves & Savitch LLP

(57) ABSTRACT

First terminals have a contact arm portion and second terminals have a convex contact point portion that is contactable with the intermediate portion of the contact arm portion of the first terminals in the direction of plugging and unplugging of the two connectors. The section of the contact arm portion of the first terminals that extends from the location of contact with the convex contact point portion of the second terminals to the free end portion of the contact arm portion in the direction of plugging and unplugging forms a stub portion. The sections of the first terminals other than the stub portion and the second terminals constitute a main transmission path. In a predetermined range that includes the location of contact in the main transmission path, the impedance of at least a partial range of said predetermined range is made smaller than the impedance of the stub portion.

7 Claims, 12 Drawing Sheets

(51) Int. Cl.
*H01R 13/11* (2006.01)
*H01R 12/71* (2011.01)

(58) Field of Classification Search
CPC .... H01R 13/6587; H01R 24/60; H01R 31/06; H01R 12/57
See application file for complete search history.

(56) References Cited

U.S. PATENT DOCUMENTS 8,047,875 B2 * 11/2011 Yamakami ..... H01R 13/6471 439/660
8,758,064 B2 * 6/2014 Nagase ..... H01R 13/6474 439/676
8,961,227 B2 * 2/2015 Gailus ..... H01R 13/26 439/607.07
9,184,523 B2 * 11/2015 Tamai ..... H01R 12/91
9,257,779 B2 * 2/2016 Tamai ..... H01R 13/6598
9,356,369 B2 * 5/2016 Tamai ..... H01R 13/6582
9,444,160 B2 * 9/2016 Tamai ..... H01R 12/7082
9,478,924 B2 * 10/2016 Tamai ..... H01R 13/6473
9,640,885 B2 * 5/2017 Amini ..... H01R 13/6583
9,667,016 B2 * 5/2017 Tamai ..... H01R 13/6467
9,711,907 B2 * 7/2017 Tamai ..... H01R 13/6469
9,716,326 B2 * 7/2017 Tamai ..... H01R 12/73
9,960,511 B2 * 5/2018 Tamai ..... H01R 12/91
10,122,134 B2 * 11/2018 Shibuya ..... H01R 24/60
10,249,989 B2 * 4/2019 Luk ..... H01R 13/6474
10,283,913 B2 * 5/2019 Takeuchi ..... H01R 13/05
10,468,798 B2 * 11/2019 Kolivoski ..... H01R 12/89
10,516,226 B2 * 12/2019 Tamai ..... H01R 12/73
10,553,970 B2 * 2/2020 Tamai ..... H01R 13/648
10,553,972 B2 * 2/2020 Tamai ..... H01R 12/721
10,566,752 B2 * 2/2020 Tamai ..... H01R 43/05
10,581,190 B1 * 3/2020 Phillips ..... H01R 13/115
10,756,465 B2 * 8/2020 Tamai ..... H01R 12/716
10,804,653 B2 * 10/2020 Benedict ..... H01R 12/721
2013/0089991 A1 * 4/2013 Ito ..... H01R 13/6587 439/65
2015/0038018 A1 * 2/2015 Matsuzawa ..... H01R 13/518 439/638
2017/0162964 A1 * 6/2017 Shan ..... H01R 12/721

* cited by examiner (A)

(B)

ELECTRICAL CONNECTOR ASSEMBLY

CROSS-REFERENCE TO RELATED APPLICATIONS

This application claims priority to Japanese Patent Application No. 2018-168012, filed Sep. 7, 2018, the contents of which are incorporated herein by reference.

BACKGROUND

Technical Field

The present invention relates to an electrical connector assembly.

Related Art

A variety of shapes are considered for the terminal contact portions placed in mutual contact when a pair of electrical connectors are mated. For example, a connector assembly in which mutual contact is established using rectilinear plug terminals that are not subject to resilient displacement and in which receptacle terminals are brought into contact with said plug terminals as a result of undergoing resilient displacement has been disclosed in the connector of Patent Document 1. The electrical connector assembly of this Patent Document 1 has a plug connector used as a connector for circuit boards and a receptacle connector used as another connector for circuit boards. The multiple terminals retained in place in array form in the plug connector are rectilinear plug terminals extending in the direction of connector plugging and unplugging, and the multiple terminals retained in place in array form in the receptacle connector are resiliently displaceable receptacle terminals. After undergoing resilient displacement and sliding under contact pressure from the above-mentioned plug terminals in the process of connector mating, said receptacle terminals come into contact with the above-mentioned plug terminals while maintaining the state of resilient displacement.

In the above-mentioned plug terminals, the sections that extend from the distal ends (free ends) on the connector mating side to an intermediate location are formed as contact arm portions that are capable of contacting the above-mentioned receptacle terminals. The specific shape of said contact arm portions is unknown, as no detailed description is provided. On the other hand, the above-mentioned receptacle terminals have protruding contact portions (convex contact point portions) formed in their distal end portions on the connector mating side, with said convex contact point portions adapted to come into contact with said contact arm portions at an intermediate location in the longitudinal direction of the above-mentioned contact arm portions. Configuring a longer effective mating length, i.e., a greater distance from the location of contact with the convex contact point portions of the receptacle terminals to the distal ends (free ends) of the plug terminals, ensures a reliable state of contact independently of the mating depth of the two connectors.

PATENT DOCUMENTS

Patent Document 1

Japanese Patent No. 6,198,712.

SUMMARY OF THE INVENTION

Technical Problem to be Solved

However, the section of a plug terminal representing the above-mentioned effective mating length, i.e., the distance from a location of contact with a convex contact point portion of a receptacle terminal to the distal end (free end) of the plug terminal, is referred to as a "stub." When high-speed signals are transmitted by connecting pairs of terminals, the transmitted signals may sometimes be reflected by said stubs and thus create resonance. As a result, there is a risk of degradation in the quality of high-speed signal transmission, e.g., the transmitted signals may be weakened.

The above-described signal reflection and, therefore, the degree of degradation in high-speed signal transmission quality reaches a maximum point when the frequency of the transmitted high-speed signals is a particular frequency (resonance frequency). Signal reflection occurs not only at the resonance frequency, but also within a predetermined range of frequencies in the vicinity of said resonance frequency. As the resonance frequency is approached, the degree of reflection increases and the high-speed signal transmission quality is simultaneously degraded.

In view of such circumstances, it is an object of the present invention to provide an electrical connector assembly capable of minimizing signal reflection and, therefore, degradation in signal transmission quality within a range of frequencies in the vicinity of the resonance frequency.

Technical Solution

It is an object to provide an electrical connector assembly capable of minimizing signal reflection and, therefore, degradation in signal transmission quality within a range of frequencies in the vicinity of a resonance frequency.

When signals are transmitted by contacting terminals having a contact arm portion extending in the direction of connector plugging and unplugging (referred to as "first terminals" for ease of discussion) and terminals having a convex contact portion (referred to as "second terminals" for ease of discussion), the section of the contact arm portion of the first terminals that extends in the above-mentioned direction of plugging and unplugging from the location of contact with the above-mentioned convex contact point portion to the free end portion of said contact arm portion forms a "stub" portion, and the main transmission path is formed by the second terminals and the section of the first terminals other than the stub portion. The inventors have found that when the impedance of a section corresponding to a predetermined range including the above-mentioned location of contact in the above-mentioned main transmission path is smaller than the impedance of the above-mentioned stub portion, signal reflection and, therefore, degradation in signal transmission quality is minimized within a range of frequencies in the vicinity of the resonance frequency. By taking this into account, the present invention attempts to determine the dimensions and shape of the terminals and the plastic terminal holder that retains said terminals in place.

<First Invention>

The electrical connector assembly according to the first invention has a first electrical connector and a second electrical connector that are mated in a manner permitting plugging into and unplugging from each other.

Such an electrical connector assembly according to the present invention is characterized in that the above-mentioned first electrical connector has multiple first terminals used for signal transmission arranged such that a direction perpendicular to the direction of plugging into and unplugging from the above-mentioned second electrical connector is the terminal array direction; said first terminals, in their free end portions located on the connector mating side, have contact arm portions extending in the above-mentioned direction of plugging and unplugging; the above-mentioned second electrical connector has multiple second terminals used for signal transmission arranged in the same direction as the above-mentioned terminal array direction; said second terminals, in their free end portions located on the connector mating side, have convex contact point portions contactable with the intermediate portions of the above-mentioned contact arm portions of the above-mentioned first terminals in the above-mentioned direction of plugging and unplugging; a section of the contact arm portions of the above-mentioned first terminals that extends from the location of contact with the convex contact point portions of the above-mentioned second terminals to the free end portion of said contact arm portions in the above-mentioned direction of plugging and unplugging forms a stub portion; the section of the first terminals other than the stub portion and the second terminals constitute a main transmission path; and, within a predetermined range including the above-mentioned location of contact in the above-mentioned main transmission path, the impedance of at least a partial range of said predetermined range is made smaller than the impedance of the above-mentioned stub portion.

In the present invention, within a predetermined range including the above-mentioned location of contact in the above-mentioned main transmission path, the impedance of at least a partial range of said predetermined range is made smaller than the impedance of the above-mentioned stub portion, as a result of which signal reflection and, therefore, degradation in signal transmission quality due to the presence of the stub portions is minimized even if the frequency of the signals transmitted over the above-mentioned main signal path is within the range of frequencies in the vicinity of the resonance frequency.

In the present invention, if the electrical length of the above-mentioned stub portion is $L_0$), then the electrical length of the section corresponding to the above-mentioned predetermined range in the above-mentioned main transmission path may be set to $4L_0$. The inventors have found that suppression of signal reflection is highly effective when the electrical length of the section corresponding to the above-mentioned predetermined range is set to about four times the electrical length of the above-mentioned stub portion. Therefore, if the electrical length of the above-mentioned stub portion is $L_0$, then setting the electrical length of the section corresponding to the above-mentioned predetermined range to $4L_0$ can more effectively minimize degradation in signal transmission quality.

In the present invention, the section corresponding to the above-mentioned predetermined range in the above-mentioned main transmission path may be adapted such that the electrical length of the section formed in a first terminal and the electrical length of the section formed in a second terminal are equal. The inventors have found that suppression of signal reflection becomes even more effective if, in the section corresponding to the above-mentioned predetermined range, the electrical length of the section formed in a first terminal is made equal to the electrical length of the section formed in a second terminal. Therefore, making the electrical length of the sections formed in the above-mentioned first terminals equal to the electrical length of the sections formed in the above-mentioned second terminals can more effectively minimize degradation in signal transmission quality.

The magnitude of a terminal's impedance is affected by the distance between said terminal and metallic members located around the periphery of said terminal (for example, other terminals, a ground plate, etc.) and by the surface area opposed thereto. Specifically, the smaller the above-mentioned opposed surface area, the smaller the capacitance of the terminal and, as a result, the larger the impedance. On the other hand, the larger the above-mentioned opposed surface area, the larger the capacitance of the terminal and, as a result, the smaller the impedance. In addition, the longer the above-mentioned distance, the smaller the capacitance of the terminal and, as a result, the larger the impedance. On the other hand, the shorter the above-mentioned distance, the larger the capacitance of the terminal and, as a result, the smaller the impedance.

In addition, the magnitude of a terminal's impedance is affected by the relative magnitude of electric permittivity around the periphery of said terminal. Specifically, the higher the permittivity around the periphery of the terminal, the larger the capacitance of the terminal and, as a result, the smaller the impedance. On the other hand, the lower the permittivity around the periphery of the terminal, the smaller the capacitance of the terminal and, as a result, the larger the impedance.

In the present invention, in the terminal array direction, the dimensions of the section corresponding to the above-mentioned predetermined range in the above-mentioned main transmission path may be made larger than the dimensions of the above-mentioned stub portion in the same direction. As a result of setting the dimensions of the section corresponding to the above-mentioned predetermined range in this manner, the inter-terminal distance in the section corresponding to the above-mentioned predetermined range becomes smaller than the inter-terminal distance in the stub portion. In addition, if a ground plate is in juxtaposition with the terminals, the surface area opposed to the above-mentioned ground plate in the section corresponding to the above-mentioned predetermined range becomes larger than the surface area opposed to the above-mentioned ground plate in the stub portion. As a result, the impedance of the section corresponding to the above-mentioned predetermined range can be made smaller than the impedance of the stub portion.

The present invention may be adapted such that dimensions in a direction perpendicular to both the terminal array direction and the direction of plugging and unplugging in the section corresponding to the above-mentioned predetermined range in the above-mentioned main transmission path are larger than dimensions in the same direction in the above-mentioned stub portion. As a result of setting the dimensions of the section corresponding to the above-mentioned predetermined range in this manner, for every two terminals adjacent in the terminal array direction, the opposed surface area of the two sections corresponding to the above-mentioned predetermined range becomes larger than the opposed surface area of the two stub portions. In addition, if a ground plate is in juxtaposition with the terminals, the distance to the above-mentioned ground plate in the section corresponding to the above-mentioned predetermined range becomes smaller than the distance to the above-mentioned ground plate in the stub portion. As a result, the impedance of the section corresponding to the above-mentioned predetermined range can be made smaller than the impedance of the stub portion.

The present invention may be adapted such that the first and second terminals are retained in place by a plastic terminal holder and at least a portion of the section corresponding to the above-mentioned predetermined range in the above-mentioned main transmission path is covered by a portion of the above-mentioned terminal holder in the above-mentioned direction of plugging and unplugging. Covering the section corresponding to the above-mentioned predetermined range with the above-mentioned terminal holder can make the impedance of the section corresponding to the above-mentioned predetermined range smaller than the impedance of the stub portion due to the fact that a plastic member of higher electric permittivity than air is present around the periphery of the section corresponding to said predetermined range.

The present invention may be adapted such that the convex contact point portions of the above-mentioned second terminals are shaped to protrude toward the contact arm portions of the above-mentioned first terminals, a guiding portion used for guiding the above-mentioned contact arm portions of the above-mentioned first terminals toward the above-mentioned locations of contact is formed within the range of the free ends of the above-mentioned second terminals, and the above-mentioned terminal holder of the above-mentioned first connector covers the above-mentioned first terminals at the location corresponding to the above-mentioned guiding portion in the above-mentioned direction of plugging and unplugging when the connectors are in a mated state.

The inventors have found that the smaller the impedance in the section corresponding to the above-mentioned predetermined range, particularly at locations in close proximity to the location of contact between the above-mentioned first terminal and the above-mentioned second terminal, the more pronounced the effect of minimizing the reflection of transmitted signals. In the present invention, as described above, when the connectors are in a mated state, the above-mentioned terminal holder covering the above-mentioned first terminals is caused to assume a position corresponding to the above-mentioned guiding portions of the second terminals, as a result of which said terminal holder becomes positioned in close proximity to the above-mentioned locations of contact in the above-mentioned direction of plugging and unplugging. As a result, impedance at locations in close proximity to the location of contact in the section corresponding to the above-mentioned predetermined range can be reduced.

Effects of the Invention

In the present invention, as described above, in a predetermined range including a location of contact between two terminals within the main transmission path through the first and second terminals, the impedance of at least a partial range of said predetermined range is made smaller than the impedance of the stub portion of the first terminals and, as a result, even if the frequency of the signals transmitted through the above-mentioned main transmission path is within the range of frequencies in the vicinity of the resonance frequency, signal reflection and, therefore, degradation in signal transmission quality due to the presence of the stub portions can be minimized.

DETAILED DESCRIPTION

Embodiments of the present invention will be described below with reference to the accompanying drawings.

First Embodiment

Figure 1:
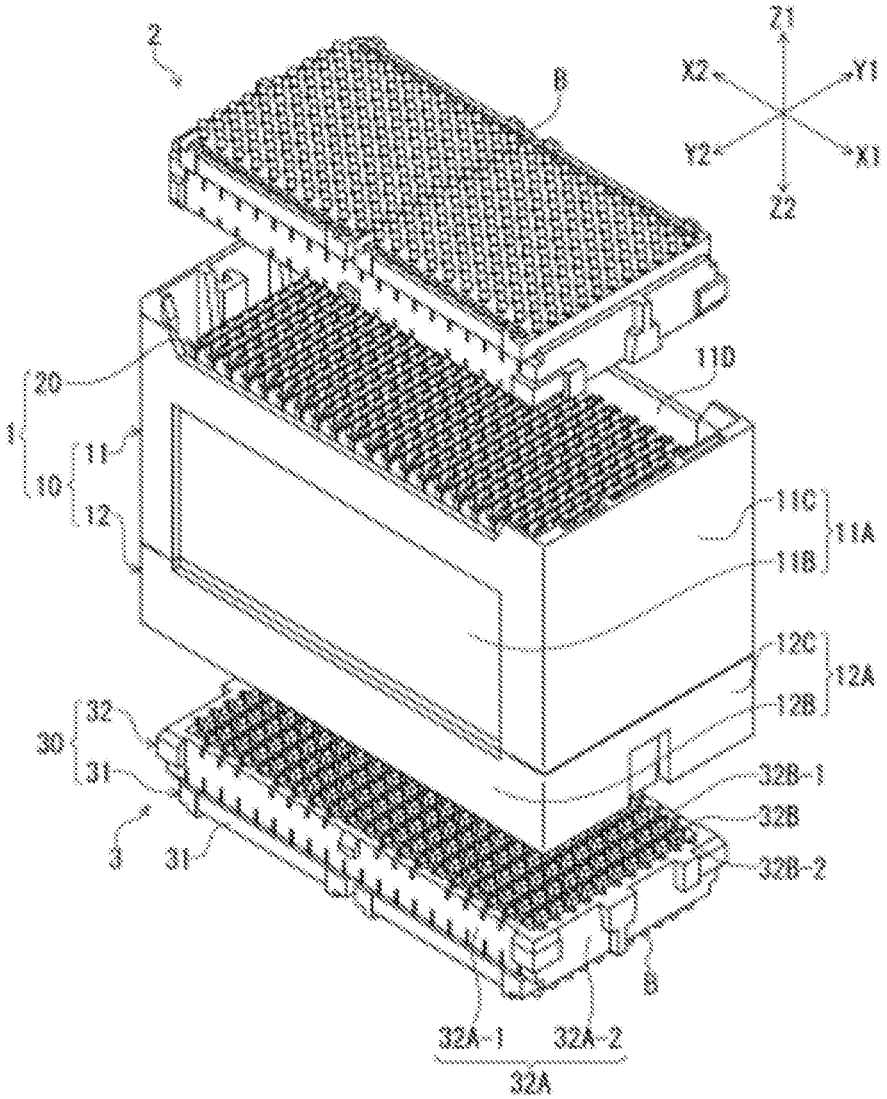
FIG. 1 illustrates a perspective view illustrating an intermediate electrical connector and counterpart connectors according to a first embodiment of the present invention, in which the connectors are shown in an unmated state.
Figure 2:
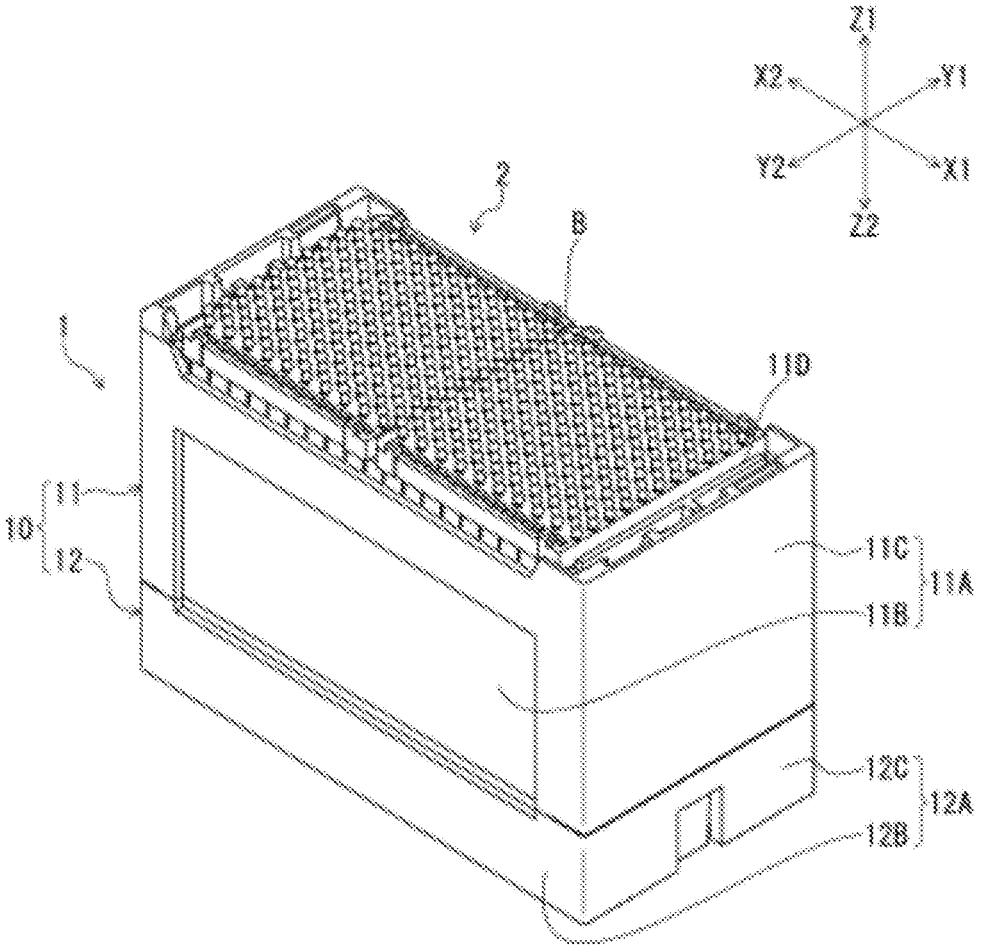
FIG. 2 illustrates a perspective view illustrating the intermediate electrical connector and counterpart connectors of FIG. 1 in a mated state.

FIG. 1 is a perspective view illustrating an intermediate electrical connector and counterpart connectors according to a first embodiment in an unmated state. In addition, FIG. 2 is a perspective view illustrating the intermediate electrical connector and counterpart connectors of FIG. 1 in a mated state.

The electrical connector assembly according to the present embodiment is a connector assembly used for the transmission of high-speed signals and has an intermediate electrical connector 1, which is used as a first electrical connector (hereinafter referred to as "intermediate connector 1"), and counterpart connectors 2, 3, which are used as second electrical connectors. The intermediate connector 1 and the counterpart connectors 2, 3 are connectors used for the transmission of high-speed signals. The counterpart connectors 2, 3 are electrical connectors for circuit boards disposed on respectively different circuit boards (not shown), which are mated with the intermediate connector 1 while being oriented such that the surface of the respective circuit boards is perpendicular to the up-down direction (Z-axis direction). In this manner, the counterpart connector 2 is mated to the intermediate connector 1 from above (side Z1) and the counterpart connector 3 is mated thereto from below (side Z2), as a result of which, as can be seen in FIG. 2, the two counterpart connectors 2, 3 are connected through the medium of the intermediate connector 1 (counterpart connector 3 not shown). In the present embodiment, the counterpart connectors 2, 3 are formed as connectors of exactly the same shape.

As can be seen in FIG. 1, the intermediate connector 1 has multiple plate-like blades 20 to be described hereinafter (see also FIGS. 3 (A) and 3 (B)) and a support 10 made of an electrically insulating material used to arrange and support the above-mentioned multiple blades 20 at predetermined intervals in the through-thickness direction thereof. Said support 10, which has a substantially rectangular parallelepiped-like external configuration whose longitudinal direction is the array direction (X-axis direction) of the blades 20, also serves as a housing. The support 10 is formed by combining an upper support member 11 and a lower support member 12 in the up-down direction.

The upper support member 11 has perimeter walls 11A of a square frame configuration when viewed from above, which enclose the multiple blades 20, and multiple restricting portions (not shown), which are used to position the respective blades 20 within a predetermined location range in the array direction of said blades 20. The perimeter walls 11A have two lateral walls 11B, which extend in the array direction (X-axis direction) of the blades 20, and two end walls 11C, which extend in the connector width direction (Y-axis direction) perpendicular to said longitudinal direction and couple the two ends of the above-mentioned two lateral walls 11B. Within the space enclosed by the perimeter walls 11A, the above-mentioned restricting portions, which are shaped as plates whose major faces are perpendicular to the array direction of the blades 20 and which couple the two interior wall surfaces of the two lateral walls 11B, are formed in array form at predetermined intervals in the above-mentioned array direction.

Slit-like spaces formed extending in the up-down direction between two mutually adjacent restricting portions or between said restricting portions and the end walls 11C constitute blade holding spaces (not shown) used to hold the blades 20. In the present embodiment, the above-mentioned restricting portions are positioned in a manner that permits abutment against the major faces of the blades 20 contained within the above-mentioned blade holding spaces, as a result of which said blades 20 can be positioned within a predetermined location range in the array direction (X-axis direction). In addition, upper stepped support portions (not shown) used to support the hereinafter-described supported protrusions 21A of the blades 20 (see FIGS. 3 (A) and 3 (B)) from above are formed on the interior wall surface of the lateral walls 11B in the above-mentioned longitudinal direction (X-axis direction) at locations that correspond to the respective blade holding spaces and, at the same time, are proximal to the lower ends in the up-down direction (Z-axis direction).

As can be seen in FIG. 1, the perimeter walls 11A extend upwardly past the upper ends of the restricting portions. The space enclosed by this upwardly extending section, which is upwardly open and, at the same time, is in communication with the above-mentioned blade holding spaces, is formed as an upper receiving portion 11D used to receive the counterpart connector 2 from above. As can be seen in FIG. 1, when the blades 20 are held within the blade holding spaces, the upper end sections of the blades 20 protrude from the upper end openings of the blade holding spaces and are located within the upper receiving portion 11D.

The lower support member 12 of the support 10 has perimeter walls 12A which, when viewed in the up-down direction, have a square frame configuration of the same dimensions as the perimeter walls 11A of the previously discussed upper support member 11. Said perimeter walls 12A have two lateral walls 12B, which extend in the array direction of the above-mentioned blades 20, and two end walls 12C, which extend in a transverse direction perpendicular to said longitudinal direction and couple the two ends of the above-mentioned two lateral walls 12B. Lower stepped support portions (not shown) used to support the hereinafter-described supported protrusions 21A of the blades 20 from below are formed on the interior wall surface of the lateral walls 12B in the above-mentioned array direction at locations that correspond to the respective blade holding spaces and, at the same time, are proximal to the upper ends in the up-down direction.

In addition, the space enclosed by the lower support member 12, which is downwardly open at a location below the lower ends of the restricting portions of the support 10 and, at the same time, is in communication with the blade holding spaces, is formed as a lower receiving portion used to receive the counterpart connector 3 from below. When the blades 20 are held within the blade holding spaces, the lower end sections of the blades 20 protrude from the lower end openings of the blade holding spaces and are located within the above-mentioned lower receiving portion.

The support 10 is assembled by fitting the lower support member 12 to the upper support member 11 from below. As can be seen in FIG. 1, when the upper support member 11 and the lower support member 12 are combined, the lateral walls of the support 10 are formed by the lateral walls 11B of the upper support member 11 and the lateral walls 12B of the lower support member 12, while the end walls of the support 10 are formed by the end walls 11C of the upper support member 11 and the end walls 12C of the lower support member 12.

Figure 3:
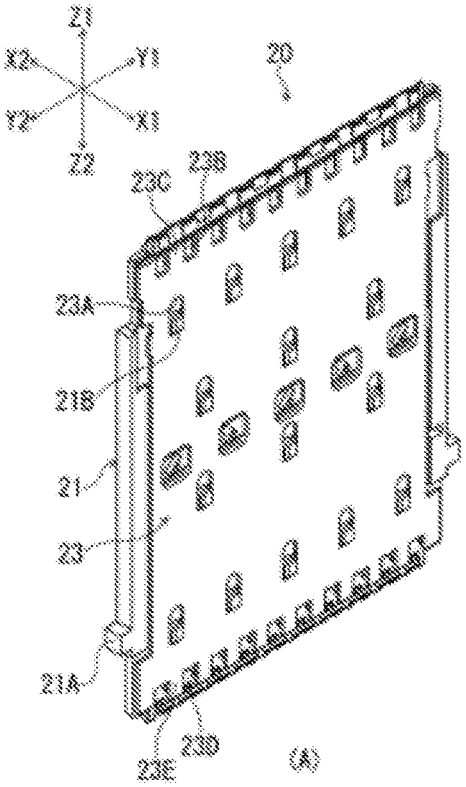
FIGS. 3 (A) and 3 (B) illustrate perspective views illustrating a blade used in the intermediate electrical connector of FIG. 1, wherein FIG. 3 (A) shows a view from the side of the ground plate, and FIG. 3 (B) shows a view from the side of the terminal array face.
Figure 3:
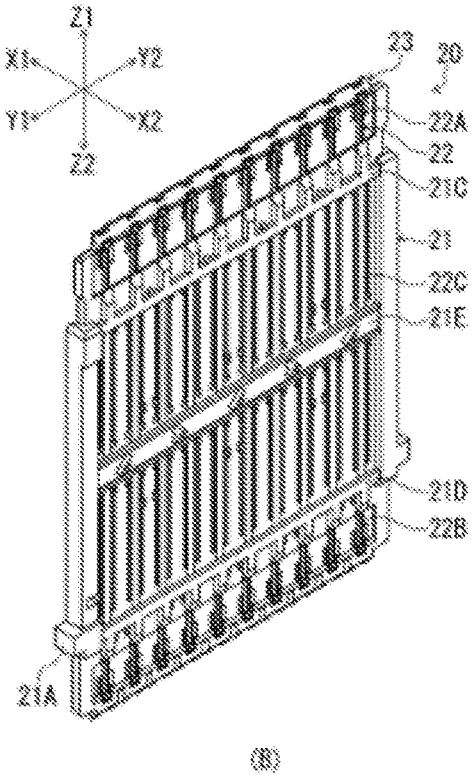
Figure 4:
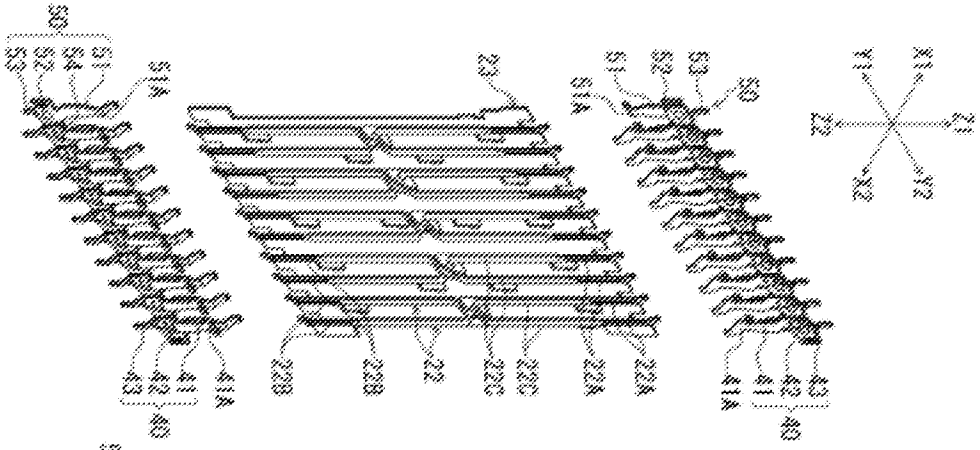
FIGS. 4 (A) and 4 (B) illustrate perspective views from the side of the terminals, in which the terminals and the ground plate are shown removed from the blade of FIG. 3 (B) and, at the same time, the counterpart signal terminals and the counterpart ground members are shown removed from the counterpart connectors, wherein FIG. 4 (A) illustrates a state prior to connector mating, and FIG. 4 (B) illustrates the connectors in a mated state.
Figure 4:
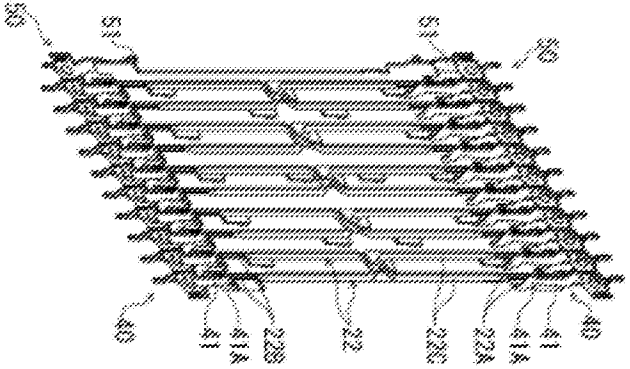

FIGS. 3 (A) and 3 (B) provide perspective views of a single blade 20, wherein FIG. 3 (A) shows a view from the side of the ground plate, and FIG. 3 (B) shows a view from the side of the terminal array face. FIGS. 4 (A) and 4 (B) illustrate a view from the side of the terminals 22, in which the terminals 22 and the ground plate 23 are shown removed from the blade 20 of FIG. 3 (B) and, at the same time, the counterpart signal terminals 40 and ground members 50 are shown removed from the counterpart connectors 2, 3, wherein FIG. 4 (A) illustrates a state prior to connector mating, and FIG. 4 (B) shows the connectors in a mated state.

As shown in FIGS. 3 (A) and 3 (B), the blade 20 has a substrate 21 used as a plate-like plastic terminal holder, vertically extending strip-shaped signal terminals 22 used as multiple first terminals, which are retained in place in array form via unitary co-molding on one major face of the substrate 21 (surface extending in the Y-Z direction), and a single metal ground plate 23 attached to the other major face of the substrate 21. Below, the above-mentioned first major face is referred to as a "terminal array face," and the above-mentioned other major face is referred to as a "ground plate mounting face."

As can be seen in FIGS. 3 (A) and 3 (B), the substrate 21 has supported protrusions 21A formed as projections at locations proximal to the lower ends of its vertically extending two lateral edges and, as described below, said supported protrusions 21A are adapted to be supported by the upper stepped support portions and lower stepped support portions of the support 10 from above and below. As can be seen in FIG. 3 (A), the substrate 21 has multiple retaining studs 21B used to retain the ground plate 23 in place formed as projections on its ground plate mounting face.

In addition, as can be seen in FIG. 3 (B), an upper cover portion 21C, a lower cover portion 21D, and a central cover portion 21E, which partially cover the signal terminals 2, are formed on the terminal array face of the substrate 21 at locations respectively proximal to the upper end, lower end, and center of said substrate 21. The upper cover portion 21C, which extends over the terminal array range, covers the upper end sections of the hereinafter-described intermediate line portions 22C of said signal terminals 22 with sections extending in the up-down direction at the locations of said signal terminals 22 in the terminal array direction (Y-axis direction). The lower cover portion 21D, whose shape is an inverse of the upper cover portion 21C in the up-down direction, covers the lower end sections of the hereinafter-described intermediate line portions 22C of said signal terminals 22 with sections extending in the up-down direction at the locations of the signal terminals 22 in the terminal array direction (Y-axis direction). The central cover portion 21E, which extends over the terminal array range, covers a curved section formed in the central area of the hereinafter-described intermediate line portions 22C of the signal terminals 22 in the up-down direction.

The multiple signal terminals 22, which are fabricated by stamping and partially bending a metal sheet in the through-thickness direction, have a strip-like general configuration extending in the up-down direction (Z-axis direction). Said signal terminals 22, whose major faces are oriented at right angles to the array direction (X-axis direction) of the blades 20, are arranged at equal intervals in a terminal array direction coinciding with the width direction (Y-axis direction) of the blades 20 and are retained in place on the substrate 21 via unitary co-molding.

In the present embodiment, pairs of mutually adjacent signal terminals 22 are formed as paired terminals intended for the transmission of high-speed differential signals. An example in which 5 pairs of paired terminals are provided in a single blade 20 is illustrated in FIG. 3 (B) and FIGS. 4 (A) and 4 (B). Among the 5 pairs of paired terminals, the two pairs located at both ends in the connector width direction (Y-axis direction) and the single pair of paired terminals located in the center do not cross, but form pseudo cross-pairs which, as a result of being bent so as to approach each other at an intermediate location in the up-down direction, appear to intersect when viewed in the array direction (X-axis direction) of the blades 20. In addition, the rest of the paired terminals form cross-pairs crossing each other at an intermediate location in the up-down direction. In the present embodiment, the transmission of high-speed differential signals is made possible by forming pseudo cross-pairs or cross-pairs made up of two mutually adjacent signal terminals 22 in this manner.

As can be seen in FIGS. 4 (A) and 4 (B), at their upper end, a pair of signal terminals 22 forming a pseudo cross-pair has formed therein upper contact arm portions 22A used for contacting the hereinafter-described counterpart signal terminals 40 provided in the counterpart connector 2 and, at their lower end, has formed therein lower contact arm portions 22B used for contacting the counterpart signal terminals 40 provided in the counterpart connector 3, with said upper contact arm portions 22A and said lower contact arm portions 22B coupled by vertically extending intermediate line portions 22C. Said upper contact arm portions 22A and said lower contact arm portions 22B are shaped to be vertically symmetrical. Below, the upper contact arm portions 22A and lower contact arm portions 22B are referred to as "contact arm portions 22A, 22B" for ease of discussion when there is no need to distinguish between the two.

The upper end portions (free end portions) of the upper contact arm portions 22A and the lower end portions (free end portions) of the lower contact arm portions 22B are bent in a crank-like configuration to one side (side X1 in FIGS. 4 (A) and 4 (B)) in the through-thickness direction thereof (X-axis direction). A major portion of the free ends of said contact arm portions 22A, 22B bent in a crank-like configuration is embedded in the substrate 21 (see FIG. 4 (B), FIGS. 5 (A) and 5 (B), and FIG. 6 (A)). On the other hand, the rectilinear sections of the contact arm portions 22A, 22B not including the above-mentioned free end portions have their two vertically extending lateral end faces (through-thickness faces) and their major faces located on side X1 (rolled faces) retained in place on the substrate 21, with their faces on side X2 exposed on said substrate 21.

The width dimensions (dimensions in the Y-axis direction) of the contact arm portions 22A, 22B are made smaller and narrower than those of the intermediate line portions 22C. In addition, the contact arm portions 22A, 22B are narrower than the hereinafter-described resilient signal arm portions 41 of the counterpart signal terminals 40 provided in the counterpart connectors 2, 3 (see FIGS. 6 (A) and 6 (B)). Therefore, the spacing between two upper contact arm portions 22A and two lower contact arm portions 22B mutually adjacent in the Y-axis direction is wider than the spacing between two rectilinear sections of mutually adjacent intermediate line portions 22C of the signal terminals 22 and the spacing between two resilient signal arm portions 41 of the counterpart signal terminals 40.

Figure 6:
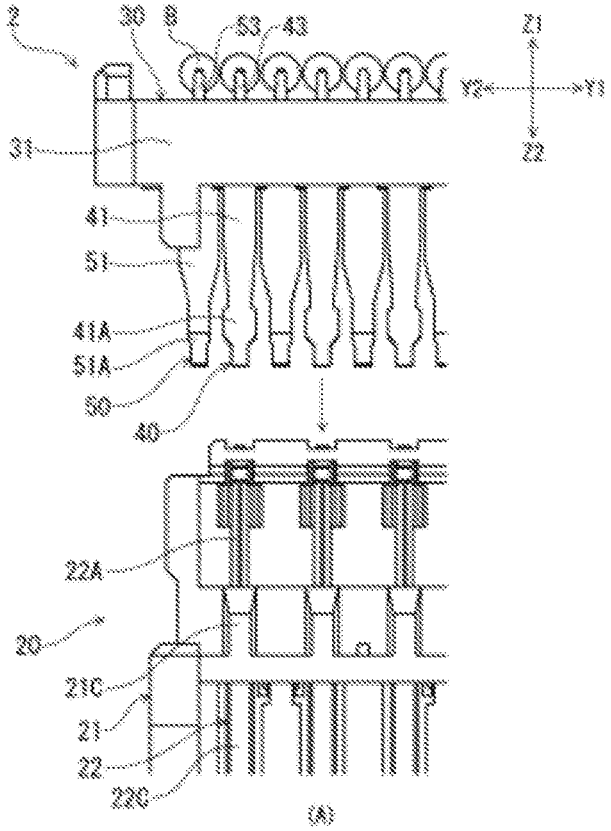
FIGS. 6 (A) and 6 (B) illustrate partial views of the intermediate electrical connector and a counterpart connector as seen in the blade array direction, wherein FIG. 6 (A) illustrates a state prior to connector mating, and FIG. 6 (B) illustrates the connectors in a mated state.
Figure 6:
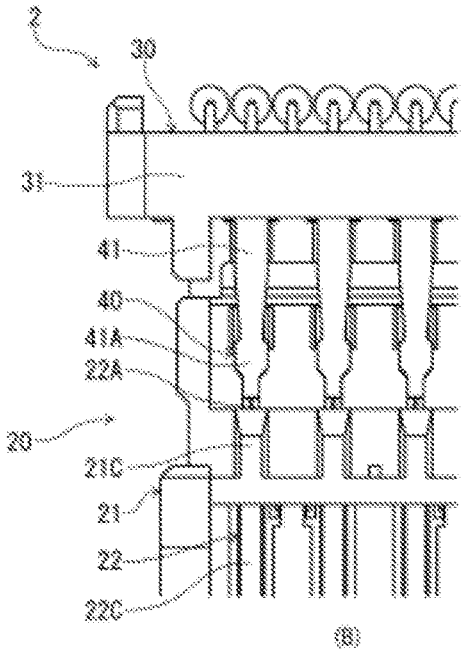

In addition, the exposed faces (faces on side X2) of the above-mentioned rectilinear sections of the contact arm portions 22A, 22B form inclined surfaces inclined toward side X1 as one moves from the central area in the terminal width direction (Y-axis direction) toward the two lateral ends in the terminal width direction (see FIG. 4 (A) and FIG. 6 (A)). In other words, as a result of forming the above-mentioned inclined surfaces, the through-thickness dimensions (dimensions in the X-axis direction) of said contact arm portions 22A, 22B are made smaller than those of the intermediate line portions 22C.

Figure 5:
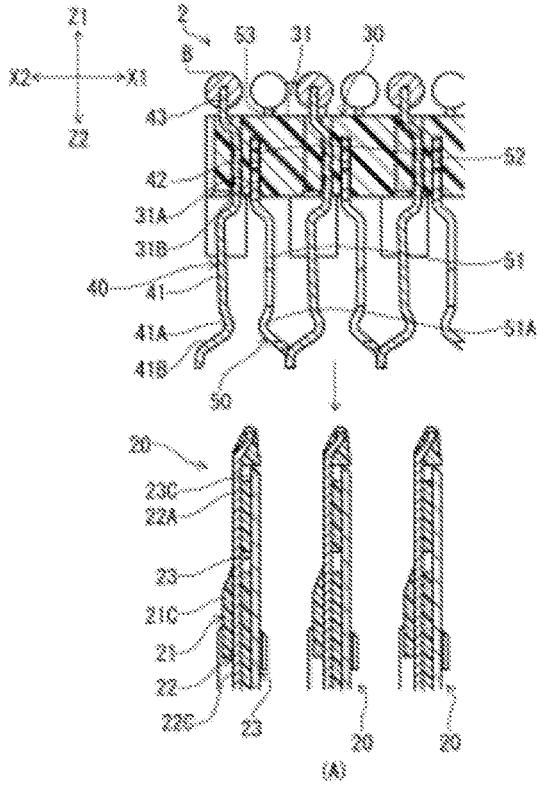
FIGS. 5 (A) and 5 (B) illustrate partial cross-sectional views taken at the location of the signal terminals of the intermediate electrical connector and a counterpart connector in the connector width direction, wherein FIG. 5 (A) illustrates a state prior to connector mating, and FIG. 5 (B) illustrates the connectors in a mated state.
Figure 5:
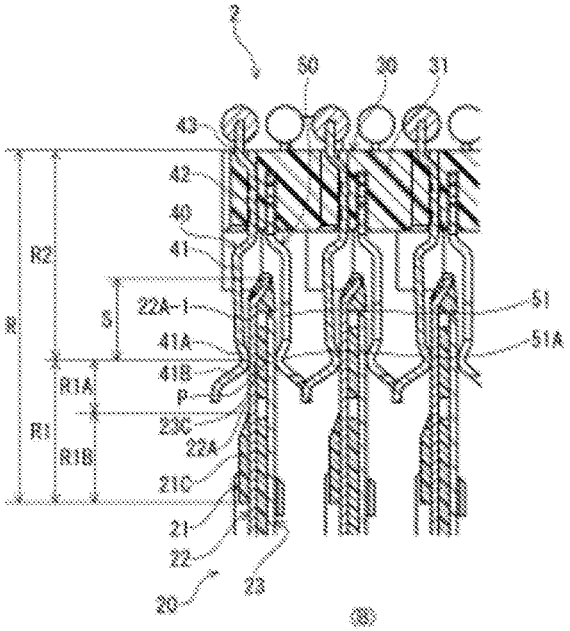

As can be seen in FIG. 5 (B), in a state of contact with the convex signal contact point portions 41A of the hereinafter-described counterpart signal terminals 40, a section corresponding to a range S (hereinafter, "stub range S") extending in the up-down direction from the location of contact P with said convex signal contact point portions 41A to the free end (upper end) of said upper contact arm portions 22A constitutes a stub portion 22A-1. The length of said stub portion 22A-1 will be longer or shorter depending on the location of contact P of the upper contact arm portions 22A with the convex signal contact point portions 41A in the up-down direction. Namely, the closer said location of contact P is to the proximal end (lower end in FIG. 5 (B)) of the upper contact arm portions 22A, the larger the stub range S becomes and, correspondingly, the longer the stub portion 22A-1 will be; and, the closer said location of contact P is to the upper end (upper end in FIG. 5 (B)) of the upper contact arm portions 22A, the smaller the stub range S becomes and, correspondingly, the shorter the stub portion 22A-1 will be.

It should be noted that while in the present embodiment the contact arm portions 22A, 22B of the signal terminals 22 are designed to be unitarily molded and retained in place on the substrate 21 without resilient displacement, absence of resilient displacement is not of the essence. For example, by extending the contact arm portions from the ends of the substrate 21 in the up-down direction, the contact arm portions may be formed in a manner permitting resilient displacement in the through-thickness direction of said contact arm portions.

As can be seen in FIGS. 4 (A) and 4 (B), after extending so as to approach each other in the central area in the up-down direction, the intermediate line portions 22C of the signal terminals 22 that form pseudo cross-pairs then extend in a curved shape so as go back to the intermediate line portions 22C. Although two portions forming part of one intermediate line portion 22C and another intermediate line portion 22C overlap in the above-mentioned central area in said pseudo cross-pairs when viewed in the X-axis direction, these intermediate line portions 22C are not in contact as a result of being bent in a direction that keeps them spaced apart in the through-thickness direction (X-axis direction). Further, as can be seen in FIGS. 4 (A) and 4 (B), the intermediate line portions 22C of the signal terminals 22 forming the cross-pairs intersect without coming into contact with each other because one intermediate line portion 22C and the other intermediate line portion 22C are bent in a direction that keeps them spaced apart in the through-thickness direction in the central area in the up-down direction.

The upper end sections of the intermediate line portions 22C coupled to the upper contact arm portions 22A, the lower end sections coupled to the lower contact arm portions 22B, and parts of the curved sections formed in the above-mentioned central area are embedded in the substrate 21 (see FIG. 3 (B)). As far as other sections of said intermediate line portions 22C are concerned, as can be seen in FIG. 3 (B), the two lateral end faces (through-thickness faces) and major faces located on side X1 (rolled faces) are retained in place on the substrate 21, and the faces on side X2 are exposed on said substrate 21.

The ground plate 23 is fabricated by stamping sheet metal. As can be seen in FIG. 3 (A), multiple retained aperture portions 23A used to receive the retaining studs 21B of the substrate 21 are formed through the ground plate 23 at locations corresponding to each retaining stud 21B. Said retained aperture portions 23A form long holes larger than the retaining studs 21B in the up-down direction, with the dimensions of said long holes being slightly larger than those of the retaining studs 21B in the top halves, and slightly smaller than those of the retaining studs 21B in the bottom halves.

The upper end portion of the ground plate 23 has formed therein multiple upper notched portions 23B cut out at equal intervals in the terminal array direction (Y-axis direction), and upper ground contact portions 23C, which are contactable with the hereinafter-described convex ground contact point portions 51A of the ground members 50 provided in the counterpart connector 2, are formed on both sides of said upper notched portions 23B. The upper ground contact portions 23C are provided at locations between two upper contact arm portions 22A of the signal terminals 22 in the terminal array direction (Y-axis direction) as well as at the same location as the upper end portions of the above-mentioned upper contact arm portions 22A in the up-down direction (Z-axis direction). In addition, the lower end portion of the ground plate 23 is shaped as a vertical inversion of the upper end portion and has formed therein lower notched portions 23D and lower ground contact portions 23E.

When the ground plate 23 is mounted to the substrate 21, the retaining studs 21B of the substrate 21 are introduced into the top halves of the respectively corresponding retained aperture portions 23A and the ground plate 23 is brought into surface contact with the ground plate mounting face of the substrate 21. While in this surface contact state, the ground plate 23 is slid in the upward direction, thereby causing the retaining studs 21B to be press-fitted into the bottom halves of the retained aperture portions 23A. As a result, as can be seen in FIG. 3 (A), the ground plate 23 is retained in place while covering substantially the entire extent of the above-mentioned ground plate mounting face of the substrate 21, thereby finishing the blades 20.

The intermediate connector 1 according to the present embodiment is assembled in accordance with the following procedure. First, the blades 20 are inserted into the respective multiple blade holding spaces of the upper support member 11 from below said upper support member 11. At such time, all the blades 20 are oriented such that their terminal array faces face toward the same side (side X2) (see FIGS. 5 (A) and 5 (B)). Next, the lower support member 12 is fitted to the upper support member 11 from below, thereby completing the assembly of the intermediate connector 1. Here, the supported protrusions 21A of the blades 20 are supported from above and below between the upper stepped support portions of the upper support member 11 and the lower stepped support portions of the lower support member 12, thereby preventing extraction of the blades 20 from the above-mentioned blade holding spaces.

The configuration of the counterpart connectors 2, 3 will be described below. Since the counterpart connectors 2, 3 have exactly the same configuration, here, the discussion will focus primarily on the counterpart connector 3 while appropriately referencing the configuration of the counterpart connector 2 illustrated in FIG. 5 and FIG. 6. As can be seen in FIG. 1, the counterpart connector 3 has a plastic housing 30, which is formed in a rectangular parallelepiped-like external configuration adapted to the lower receiving portion of the intermediate connector 1, counterpart signal terminals 40, which serve as multiple second terminals and are retained in said housing 30 in array form (see FIG. 5 and FIG. 6), and ground members 50, which extend in the connector width direction (Y-axis direction) over the terminal array range and are retained in the housing 30 (see FIG. 5 and FIG. 6).

As can be seen in FIG. 1, the housing 30 has a plastic holder 31 serving as a terminal holder, which extends parallel to the mounting face of a circuit board (not shown) and retains the counterpart signal terminals 40 and ground members 50 in place, and a plastic container 32, which is fitted to said holder 31 from above and accommodates the counterpart signal terminals 40 and ground members 50. The holder 31 has formed therein signal-type retaining aperture portions 31A in which the hereinafter-described signal-side retained portions 42 of the counterpart signal terminals 40 are secured via press-fitting, and grounding-type retaining aperture portions 31B in which the hereinafter-described ground-side retained portions 52 of the ground members 50 are secured via press-fitting (see FIGS. 5 (A) and 5 (B)). The above-mentioned signal-type retaining aperture portions 31A and grounding-type retaining aperture portions 31B are formed through the holder 31 in the up-down direction.

The container 32 has perimeter walls 32A, which have a square frame configuration when viewed in the up-down direction, and multiple containing walls 32B, which extend in the connector width direction (Y-axis direction) in the space enclosed by said perimeter walls 32A. The perimeter walls 32A have two lateral walls 32A-1, which extend in the longitudinal direction (X-axis direction) of the housing 30, and two end walls 32A-2, which extend in the connector width direction (Y-axis direction), i.e., in a transverse direction perpendicular to said longitudinal direction, and couple the two ends of the above-mentioned two lateral walls 32A-1. The multiple containing walls 32B extend in the connector width direction (Y-axis direction) and couple the two lateral walls 32A-1. Signal-type holding grooves 32B-1, which are used to hold the hereinafter-described resilient signal arm portions 41 of the counterpart signal terminals 40, are formed extending in the up-down direction on the major face that is located on side X2 of the two major faces (faces extending in the Y-Z direction) of said containing walls 32B. Meanwhile, grounding-type holding grooves 32B-2, which are used to hold the hereinafter-described grounding resilient arm portions 51 of the ground members 50, are formed extending in the up-down direction on the major face of the containing walls 32B located on side X1.

As can be seen in FIGS. 4 (A) and 4 (B), the multiple counterpart signal terminals 40, which are made of strip-shaped sheet metal members extending in the up-down direction and have their major faces oriented perpendicular to the longitudinal direction (X-axis direction) of the counterpart connector 2, are arranged in alignment with the terminals 22 of the intermediate connector 1 in the connector width direction (Y-axis direction). Said counterpart signal terminals 40, which are provided along the major faces of the containing walls 32B located on side X1, are secured within the signal-type holding grooves 32B-1 via press-fitting. In the present embodiment, the through-thickness dimensions (dimensions in the X-axis direction) of the counterpart signal terminals 40 are made larger than the through-thickness dimensions of the lower contact arm portions 22B of the signal terminals 22 provided in the intermediate connector 1. In addition, as far as the resilient signal arm portions 41 are concerned, the terminal width dimensions (dimensions in the Y-axis direction) of the hereinafter-described resilient signal arm portions 41 and signal-side retained portions 42 are made larger than the terminal width dimensions of the lower contact arm portions 22B of the signal terminals 22 provided in the intermediate connector 1.

As can be seen in FIG. 4 (A), the counterpart signal terminals 40 have resilient signal arm portions 41, which extend in the up-down direction and are resiliently displaceable in their through-thickness direction (X-axis direction), signal-side retained portions 42, which extend downwardly from the lower ends of said resilient signal arm portions 41, and signal connecting portions 43, which extend downwardly from the lower ends of said signal-side retained portions 42. The resilient signal arm portions 41 extend upwardly from the top face of the holder 31 of the housing 30 through the signal-type holding grooves 32B-1 of the container 32 (see FIG. 1). Convex signal contact point portions 41A protruding in a convex curved configuration toward side X1, in other words, toward the terminals 22 of the intermediate connector 1 when the connectors are in a mated state, are formed by bending in the upper end portions (free end portions) of said resilient signal arm portions 41. The sections protruding outside the signal-type holding grooves 32B-1 (protruding apex portions) of said convex signal contact point portions 41A are resiliently contactable with the lower contact arm portions 22B of the signal terminals 22 of the intermediate connector 1. In addition, guiding portions 41B used for guiding the signal terminals 22 of the intermediate connector 1 in the X-axis direction toward the regular locations of contact are formed within the range that is located closer to the free ends, i.e., to the upper ends, than the protruding apex portions of the convex signal contact point portions 41A (see FIGS. 5 (A) and 5 (B)).

It should be noted that while in the present embodiment the sections of the counterpart signal terminals 40, in which the convex signal contact point portions 41A are formed, are resiliently displaceable resilient signal arm portions 41, being capable of resilient displacement is not essential for said sections. For example, vertically extending contact arm portions not capable of resilient displacement may be provided in the counterpart signal terminals 40 instead of the above-mentioned resilient signal arm portions 41, and convex signal contact point portions may be formed in said contact arm portions.

The signal-side retained portions 42 are press-fitted into the signal-type retaining aperture portions 31A of the holder 31 of the housing 30 from above and are retained in place within said signal-type retaining aperture portions 31A because press-fit projections formed on the lateral edges of said signal-side retained portions 42 bite into the interior wall surface of the signal-type retaining aperture portions 31A. As can be seen in FIG. 1, the signal connecting portions 43, which project in a rectilinear manner downwardly from the bottom face of the holder 31 of the housing 30, have solder balls B provided at the lower ends thereof for solder connection to a circuit board (see also the solder balls B of the counterpart connector 2).

The ground members 50, which are fabricated by partially bending a single sheet metal member in the through-thickness direction, have multiple grounding resilient arm portions 51, which extend in the up-down direction and are resiliently displaceable in the through-thickness direction (X-axis direction) thereof, ground-side retained portions 52, which extend downwardly from the lower ends of said grounding resilient arm portions 51, ground connecting portions 53, which extend downwardly from the lower ends of said ground-side retained portions 52, and coupling portions 54, which couple the two lower ends of adjacent grounding resilient arm portions 51.

The grounding resilient arm portions 51 extend upwardly from the top face of the holder 31 of the housing 30 through the grounding-type holding grooves 32B-2 of the container 32. The upper end portions (free end portions) of said grounding resilient arm portions 51 are bent so as to protrude toward side X2, and the protruding sections located outside the grounding holding grooves 32B-2 form convex ground contact point portions 51A resiliently contactable with the upper ground contact portions 23C of the ground plate 23 of the intermediate connector 1. Said grounding resilient arm portions 51 are provided at locations offset with respect to the resilient signal arm portions 41 of the counterpart signal terminals 40 in the connector width direction (Y-axis direction).

The ground-side retained portions 52 are press-fitted into the signal-type retaining aperture portions 31A of the holder 31 of the housing 30 from above and are retained in place within said signal-type retaining aperture portions 31A because press-fit projections formed on the lateral edges of said ground-side retained portions 42 bite into the interior wall surface of the signal-type retaining aperture portions 31A. As can be seen in FIG. 1, the ground connecting portions 53, which project in a rectilinear manner downwardly from the bottom face of the holder 31 of the housing 30, have solder balls B provided at the lower ends thereof for solder connection to a circuit board (see also the solder balls B of the counterpart connector 2). The coupling portions 54 extend in the connector width direction between the lower end portions of adjacent grounding resilient arm portions 51 and couple said two lower ends.

Since the counterpart connector 2 has the same configuration as the previously discussed counterpart connector 3, the respective components of the counterpart connector 2 are assigned the same reference numerals as the corresponding sections of the counterpart connector 3 and not further discussed herein.

Next, the operation of connector mating will be described with reference to FIG. 1, FIG. 2, FIG. 5, and in FIG. 6. FIG. 5 provides cross-sectional views taken at the location of the signal terminals 22 and counterpart signal terminals 40 of the intermediate connector 1 and counterpart connector 2 in the connector width direction, wherein FIG. 5 (A) illustrates a state prior to connector mating, and FIG. 5 (B) illustrates the connectors in a mated state. In addition, FIG. 6 provides partial views of the intermediate connector 1 and the counterpart connector as seen in the array direction of the blades 20, wherein FIG. 6 (A) illustrates a state prior to connector mating, and FIG. 6 (B) illustrates the connectors in a mated state. FIG. 5 and FIG. 6 provide enlarged partial cross-sectional views of the state in which in which support 10 of the intermediate connector 1 and the container 32 of the counterpart connector 2 have been removed.

First, the counterpart connectors 2, 3 are solder-connected to the corresponding circuits of the respectively corresponding circuit boards and, as shown in FIG. 1, the intermediate connector 1 is positioned above the counterpart connector 3. The intermediate connector 1 and the counterpart connector 3 are then mated by lowering the intermediate connector 1 (see FIG. 2). At such time, the entire counterpart connector 3 is accommodated within the lower receiving portion of the intermediate connector 1.

In the process of connector mating, the lower end portions of the blades 20 resiliently displace the grounding resilient arm portions 51 of the ground members 50 and the resilient signal arm portions 41 of the counterpart signal terminals 40 of the counterpart connector 3 so as to spread them apart and enter between the two from above. Then, in the mated state, when the resilient signal arm portions 41 are in a state of resilient displacement, the convex signal contact point portions 41A of the counterpart signal terminals 40 provided in the counterpart connector 3 are brought into contact with, and electrically connected to, the intermediate portions in the up-down direction of the lower contact arm portions 22B of the signal terminals 22 provided in the blades 20 of the intermediate connector 1.

In addition, in the mated state, when said grounding resilient arm portions 51 of the ground members 50 are in a state of resilient displacement, the convex ground contact point portions 51A of the ground members 50 provided in the counterpart connector 3 are brought into contact with, and electrically connected to, the lower ground contact portions 23E of the ground plate 23 provided in the blades 20 of the intermediate connector 1 (see also FIG. 5 (B), which illustrates the upper ground contact portions 23C of the counterpart connector 2). The state of contact of the signal terminals 22 and the counterpart signal terminals 40 as well as the state of contact of the ground plate 23 and the ground members 50 between the intermediate connector 1 and the counterpart connector 3 are identical to the state of contact between the intermediate connector 1 and the counterpart connector 2 described hereinafter with reference to FIGS. 5 (A) and 5 (B).

Next, as can be seen in FIG. 1, FIG. 5 (A), and FIG. 6 (A), the counterpart connector 2 is positioned above the intermediate connector 1 in an orientation obtained by flipping that of the counterpart connector 3. The intermediate connector 1 and the counterpart connector 2 are then mated by lowering the counterpart connector 2. At such time, as can be seen in FIG. 2, the entire counterpart connector 2 is accommodated within the upper receiving portion 11D of the intermediate connector 1.

In the process of connector mating, the upper end portions of the blades 20 resiliently displace the grounding resilient arm portions 51 of the ground members 50 and the resilient signal arm portions 41 of the counterpart signal terminals 40 of the counterpart connector 2 so as to spread them apart and enter between the two from below. Then, in the mated state, as can be seen in FIG. 5 (B), when the resilient signal arm portions 41 are in a state of resilient displacement, the convex signal contact point portions 41A of the counterpart signal terminals 40 provided in the counterpart connector 2 are brought into contact with, and electrically connected to, the intermediate portions in the up-down direction of the upper contact arm portions 22A of the signal terminals 22 provided in the blades 20 of the intermediate connector 1. As can be seen in FIG. 5 (B), at such time, when the connectors are in a mated state, a stub portion 22A-1 is formed by a section of the upper contact arm portion 22A extending from the location of contact P with the convex signal contact point portion 41A of the counterpart signal terminal 40 to the upper end portion of the upper contact arm portion 22A. In FIG. 5 (B), the vertical range of the stub portion 22A-1 is designated as "S".

In addition, as can be seen in FIG. 5 (B), after mating the connectors, when the grounding resilient arm portions 51 of the ground members 50 are in a state of resilient displacement, the convex ground contact point portions 51A of the ground members 50 provided in the counterpart connector 2 are brought into contact with, and electrically connected to, the upper ground contact portions 23C of the ground plate 23 provided in the blades 20 of the intermediate connector 1.

As can be seen in FIG. 5 (B), in the present embodiment, once the connectors are mated, a main transmission path used to transmit high-speed signals is formed by sections other than the stub portions 22A-1 in the signal terminals 22 of the intermediate connector 1 and sections other than the guiding portions 41B in the counterpart signal terminals 40 of the counterpart connector 2.

In the present embodiment, as shown in FIG. 5 (B), a predetermined range within the above-mentioned main transmission path that includes the location of contact P between the upper contact arm portion 22A of the signal terminals 22 and the convex signal contact point portion 41A of the counterpart signal terminals 40 is designated as "R". Specifically, the predetermined range R is a vertical range extending between the upper end (at the same level as the top face of the holder 31 in the up-down direction) of the signal-side retained portion 42 of the counterpart signal terminals 40 provided in the counterpart connector 2 and the lower end of the upper cover portion 21C of the substrate 21 of the blades 20 provided in the intermediate connector 1. In addition, in FIG. 5 (B), this predetermined range R is split into a first range R1 located below the location of contact P and a second range R2 located above the location of contact P such that said location of contact P forms a boundary therebetween in the up-down direction. Further, the above-mentioned first range R1 is split in the up-down direction into a first upper range R1A, which extends from the location of contact P to the upper end of the upper cover portion 21C, and a first lower range R1B, which extends from the upper end of said upper cover portion 21C to the lower end of said upper cover portion 21C.

The bottom portion of the upper contact arm portions 22A of the signal terminals 22 is located in the first upper range R1A within the first range R1, and the impedance of the first upper range R1A is substantially equal to the impedance of the range (stub range) S of the stub portion 22A-1.

The upper end sections of the intermediate line portions 22C of the signal terminals 22 are located in the first lower range R1B within the first range R1. In comparison with the stub portion 22A-1, which forms part of the upper contact arm portion 22A, the upper end sections of said intermediate line portions 22C are larger both in the terminal width direction (Y-axis direction) and in the through-thickness direction (X-axis direction). In addition, since the upper cover portion 21C of the substrate 21 is present in said first lower range R1B, the upper end sections of the intermediate line portions 22C are covered by the substrate 21 around their entire periphery. Therefore, the impedance of the first lower range R1B is smaller than the impedance of the range (stub range) S of the stub portion 22A-1.

In addition, the resilient signal arm portions 41 and signal-side retained portions 42 of the counterpart signal terminals 40 are located in the second range R2. In comparison with the stub portions 22A-1, which form part of the upper contact arm portion 22A of the signal terminals 22, said resilient signal arm portions 41 and signal-side retained portions 42 are larger both in the terminal width direction (Y-axis direction) and in the through-thickness direction (X-axis direction). In addition, the retained portions 42 are covered by the holder 31 of the plastic housing 110 around the entire periphery of said retained portions 42. Therefore, the impedance of the second range R2 is smaller than the impedance of the range (stub range) S of the stub portion 22A-1.

As discussed above, in the present embodiment, the impedance of the first lower range R1B located below the above-mentioned location of contact P within the above-mentioned predetermined range R and the second range R2 located above the above-mentioned location of contact P is smaller than the impedance of the stub range S. Making impedance in a majority of the above-mentioned predetermined range R smaller than impedance in said stub range S in this manner makes is possible to minimize signal reflection and, therefore, degradation in signal transmission quality due to the presence of the stub portions 22A-1 even if the frequency of the signals transmitted over the above-mentioned main transmission path is within the range of frequencies in the vicinity of the resonance frequency.

Although in the present embodiment, as discussed above, the impedance of the first upper range R1A is equal to the impedance of the range (stub range) S of the stub portion 22A-1, for example, as described below with reference to FIG. 7, if a mating depth position is set, as the regular location of contact, such that the above-mentioned location of contact P in the upper contact arm portions 22A of the signal terminals 22 is closer to the intermediate line portion 22C and the first upper range R1A is made smaller in the up-down direction, the range within the above-mentioned predetermined range R, in which impedance is smaller than that in the stub range S, can be increased and, as a result, signal reflection and, therefore, degradation in signal transmission quality can be effectively minimized.

Figure 7:
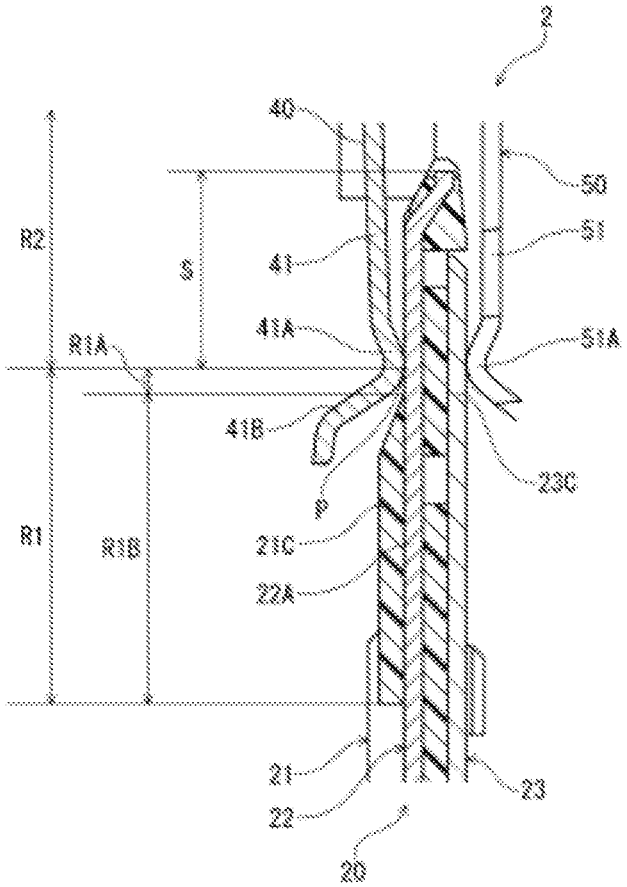
FIG. 7 illustrates a partial cross-sectional view taken at the location of the signal terminals of the intermediate electrical connector and a counterpart connector in the connector width direction in a variation of the first embodiment, in which the connectors are shown in mated state.

FIG. 7 is a partial cross-sectional view taken at the location of the signal terminals 22 of the intermediate connector 1 and a counterpart connector 2 in the connector width direction in a variation of the present embodiment in which the connectors are shown in a mated state. In the variation of FIG. 7, the shape of the upper cover portion 21C of the substrate 21 of the blade 20 is more upwardly extended in comparison with the upper cover portion 21C shown in FIG. 5 (B), with its upper end section located in alignment with the guiding portion 41B of the counterpart signal terminals 40 in the up-down direction. Shaping the upper cover portion 21C in this manner positions the upper end of said upper cover portion 21C in close proximity to the location of contact P between the two terminals in the up-down direction and, at the same time, expands the range in which the signal terminals 22 are covered by the upper cover portion 21C. As a result, impedance can be reduced over a wider range within the first range R1 and, consequently, within the above-mentioned predetermined range R.

In addition, if the electrical length of the above-mentioned stub portion 22A-1 is $L_0$, then, as described below, the electrical length of the section including the above-mentioned predetermined range R is preferably about $3L_0$ to $4L_0$. Configuring the electrical length of the section including said predetermined range R in this manner makes it possible to minimize signal reflection and, therefore, degradation in signal transmission quality in a more efficient manner.

In addition, the electrical length of the first range R1 in the signal terminals 22 of the intermediate connector 1 and the electrical length of the second range R2 in the counterpart signal terminals 40 of the counterpart connector 2 are preferably equal. Making the electrical length of the first range R1 and second range R2 equal in this manner makes it possible to minimize signal reflection and, therefore, degradation in signal transmission quality in an even more efficient manner.

While the relationship of impedance magnitudes has been described for the connection between the intermediate electrical connector 1 and the counterpart connector 2 with reference to FIGS. 5 (A) and 5 (B), FIG. 7, etc., it goes without saying that the previously described effects of the present invention will be obtained as a result of the same connection between the intermediate electrical connector 1 and the counterpart connector 3.

Figure 8:
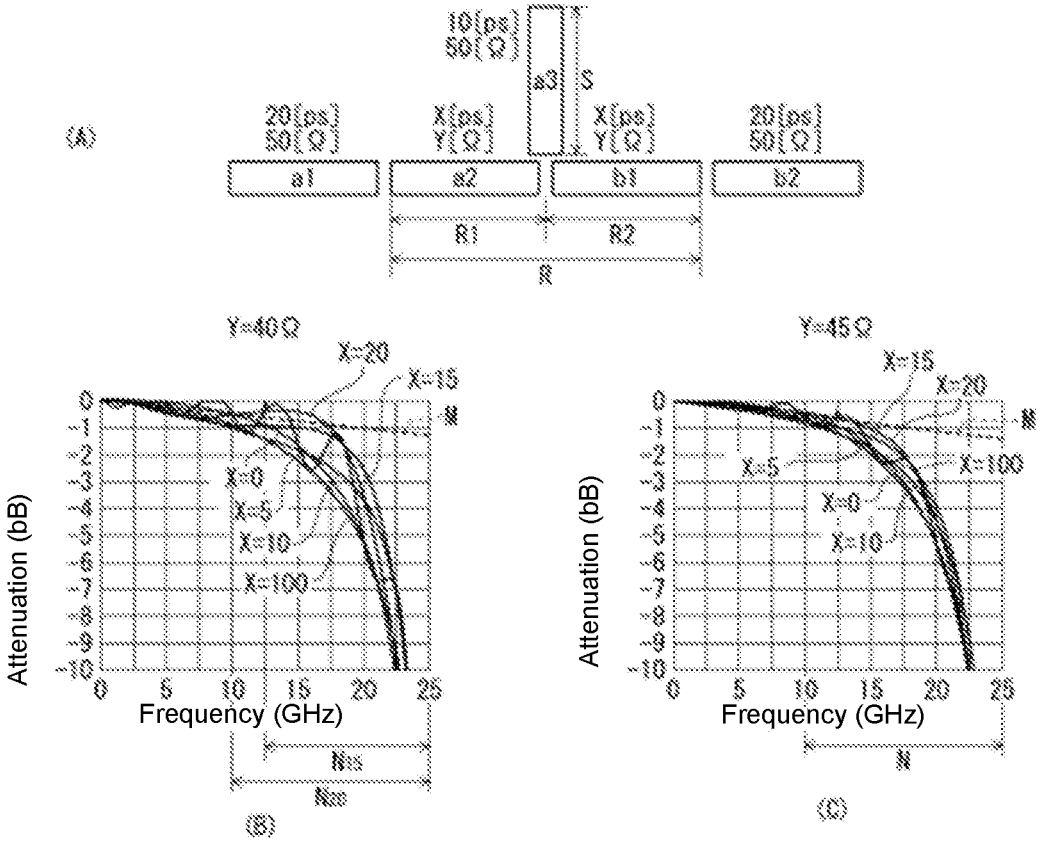
FIGS. 8 (A) to 8 (C) illustrate diagrams explaining the principles of the present invention, wherein FIG. 8 (A) is a schematic diagram showing a main transmission path and a stub portion, and FIGS. 8 (B) and 8 (C) are graphs showing relationships between the frequency of transmitted signals and the attenuation of the signals.

Next, the principles of the present invention will be described with reference to FIG. 8 (A-C) and, in addition, reasons will be explained as to why, as described below, it is preferable that the electrical length of the section including the above-mentioned predetermined range R should be approximately $3L_0$ to $4L_0$ if the electrical length of the above-mentioned stub portion 22A-1 is $L_0$. FIG. 8 (A) is a schematic diagram illustrating the main transmission path and the stub portion. In FIG. 8 (A), the main transmission path is divided into four blocks, i.e., block a1, block a2, block b1, and block b2. At the same time, the stub portion is shown as block a3. Blocks a1 to a3 are part of the signal terminals 22 of the intermediate connector 1, and blocks b1 and b2 are part of the counterpart signal terminals 40 of the counterpart connector 2.

Blocks a1 and a2 are sections formed in the signal terminals 22 within the main transmission path and blocks b1 and b2 are sections formed in the counterpart signal terminals 40 within the main transmission path. In addition, block a1 is a section located in the signal terminals 22 outside the predetermined range R in the main transmission path, and block a2 is a section located in the signal terminals 22 within the predetermined range R in the main transmission path, i.e., a section corresponding to the previously discussed first range R1. Block b1 is a section located in the counterpart signal terminals 40 outside the predetermined range R in the main transmission path, and block b2 is a section located in the counterpart signal terminals 40 within the predetermined range R in the main transmission path, i.e., a section corresponding to the previously discussed second range R2. In other words, the section consisting of block a2 and block b1 corresponds to the predetermined range R. In addition, as mentioned before, block a3 is the stub portion 22A-1 of the signal terminals 22 and corresponds to the stub range S.

An example of signal transmission via connectors in which the present invention is applied to a connector transmitting high-speed signals with a frequency of about 10-20 GHz over a signal transmission path formed with a typical impedance of 50Ω is explained below. In the example of FIG. 8 (A), the impedance of blocks a1, b2 located outside the predetermined range R in the main transmission path and that of block a3 corresponding to the stub portion is 50Ω. In addition, it is understood that, as shown in FIG. 8 (A), the electrical length of blocks a1, b2, and a3 is set, respectively, to 20 ps, 20 ps, and 10 ps. In the present invention, adjusting the electrical length X of blocks a2 and b1 located within the predetermined range R in the main transmission path and adjusting the impedance Y to a range of less than 50Ω minimizes degradation in high-speed signal transmission quality. As discussed before with reference to FIGS. 1-7, said electrical length and impedance may be adjusted using the shape and dimensions of the terminals as well as the size of the range in which the terminals are covered by the resin section, etc. In addition, they may be adjusted by the positional relationship of the signal terminals, the ground plate, and the ground terminals.

FIGS. 8 (B) and 8 (C), in which the frequency of the transmitted signal (GHz) is plotted on the horizontal axis and the attenuation of the signal (dB) is plotted on the vertical axis, are graphs illustrating relationships between the two in various insertion loss-related simulations. In FIG. 8 (B, C) shows curves representing the relationship between the frequency of the signal and the attenuation of the signal obtained by setting the electrical length and impedance of the above-mentioned predetermined range R, i.e., blocks a2 and b1 of FIG. 8 (A), to various values. In addition, in FIGS. 8 (B) and 8 (C), ideal signal attenuation in a signal transmission path formed with an impedance of 50Ω is illustrated by the downward-sloping straight line M (shown with a dashed line), according to which attenuation gently increases as the frequency becomes higher. In addition to simply reducing loss, system designers also emphasize the importance of linearity for the frequency dependence. This means that the closer the trajectory of the curve obtained in a simulation is to said straight line M, the easier it is to compensate for the loss generated in the signal transmission path using an equalizer.

The graphs of FIGS. 8 (B) and 8 (C) show curves representing the relationships between the frequency of the signal and the attenuation of the signal obtained when the electrical length X of the first range R1 and the second range R2 is set to various values if the impedance Y of blocks a2 and b1 of FIG. 8 (A), i.e., said first range R1 and said second range R2, is set to 40Ω (FIG. 8 (B)) or 45Ω (FIG. 8 (C)). The above-mentioned electrical length X is set to various values including 0 ps, 5 ps, 10 ps, 15 ps, 20 ps, and 100 ps. Here, setting the electrical length X to 0 means that no sections with an impedance of less than 50Ω are formed and impedance throughout the entire range of the stub portion and the main transmission path is set to 50Ω. Therefore, as a result of comparing the curve obtained when the electrical length X is set to 0 (the former) with the curves obtained when the electrical length X is set to other values (the latter), it can be said that the wider the frequency range in which the signal attenuation of the latter is smaller than the signal attenuation of the former, in other words, in which degradation in signal transmission quality can be improved in comparison with the former (the range designated by "N" in FIGS. 8 (B) and 8 (C), hereinafter referred to as "improvement frequency range"), the more preferable the electrical length will be.

As can be seen in FIG. 8 (B), when the impedance of the first range R1 and second range R2 is 40Ω, the curves obtained when the electrical length X is 15 ps and 20 ps are close to the shape of the straight line M. In FIG. 8 (B), the improvement frequency range $N_{15}$ obtained when the electrical length X is 15 ps is about 12.5-25 GHz, overlapping with most of the frequency range of the transmitted high-speed signals (about 10-20 GHz). In addition, the improvement frequency range $N_{20}$ obtained when the electrical length X is 20 ps is about 10-25 GHz, comprising the frequency range of the transmitted high-speed signals (about 10-20 GHz) in its entirety. Therefore, in the first range R1 and second range R2, degradation in signal transmission quality is adequately minimized by setting the impedance to 40Ω and the electrical length to 15-20 ps.

As can be seen in FIG. 8 (C), when the impedance of the first range R1 and second range R2 is 45Ω, the curve obtained when the electrical length X is 20 ps is closest to the shape of the straight line M. In FIG. 8 (C), the improvement frequency range N is approximately 10-25 GHz. Therefore, the improvement frequency range N includes the frequency range of the transmitted high-speed signals (about 10-20 GHz) in its entirety. Consequently, in the first range R1 and second range R2, degradation in signal transmission quality is adequately minimized by setting the impedance to 45Ω and the electrical length to 20 ps.

Thus, based on the simulation results illustrated in FIGS. 8 (B) and 8 (C), it was found that setting the electrical length of the first range R1 and second range R2 to 15-20 ps makes it possible to more effectively minimize degradation in signal transmission quality. In other words, the sum total of the electrical length of the first range R1 and the electrical length of the second range R2 is 30-40 ps, and this total electrical length corresponds to 3 to 4 times the electrical length of the stub range S, which is 10 ps. Therefore, if the electrical length of the above-mentioned stub portion is $L_0$, then it can be said that the electrical length of the section including the above-mentioned predetermined range R is preferably about $3L_0$ to $4L_0$.

The frequency band, electrical length, impedance, improvement frequency range, and other numerical values described above with reference to FIGS. 8 (A) to 8 (C) are merely an example, and it goes without saying that the invention is not limited to these numerical values. To obtain the effect of minimizing degradation in signal transmission quality, the impedance of at least a partial range of the above-mentioned predetermined range R within the above-mentioned main transmission path should be smaller than the impedance of the range of the stub portion (stub range). In addition, at such time, impedance in sections outside the above-mentioned predetermined range R in the main transmission path may also be smaller than that of the stub portion. Therefore, for example, the impedance of a range extending over the entire main transmission path may be adjusted to be smaller than the impedance of the stub portion.

Second Embodiment

While in the first embodiment explanations were provided regarding an embodiment obtained by applying the present invention to a so-called three-piece electrical connector assembly composed of a single intermediate connector 1 and two counterpart connectors 2, 3, the second embodiment differs from the first embodiment in that the present invention is applied to a so-called two-piece electrical connector assembly composed of a connector and a counterpart connector.

Figure 9:
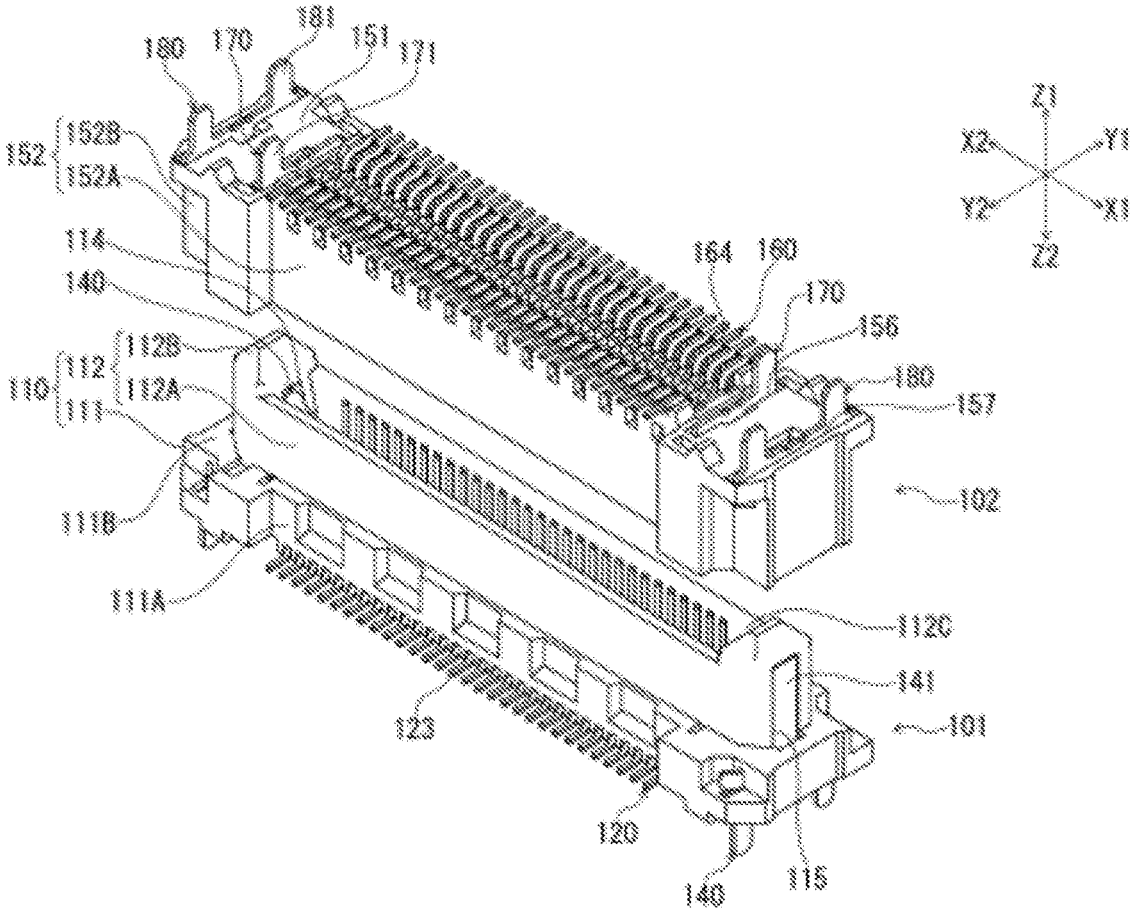
FIG. 9 illustrates a perspective view illustrating an electrical connector and a counterpart connector according to a second embodiment of the present invention, in which the connectors are in an unmated state.
Figure 10:
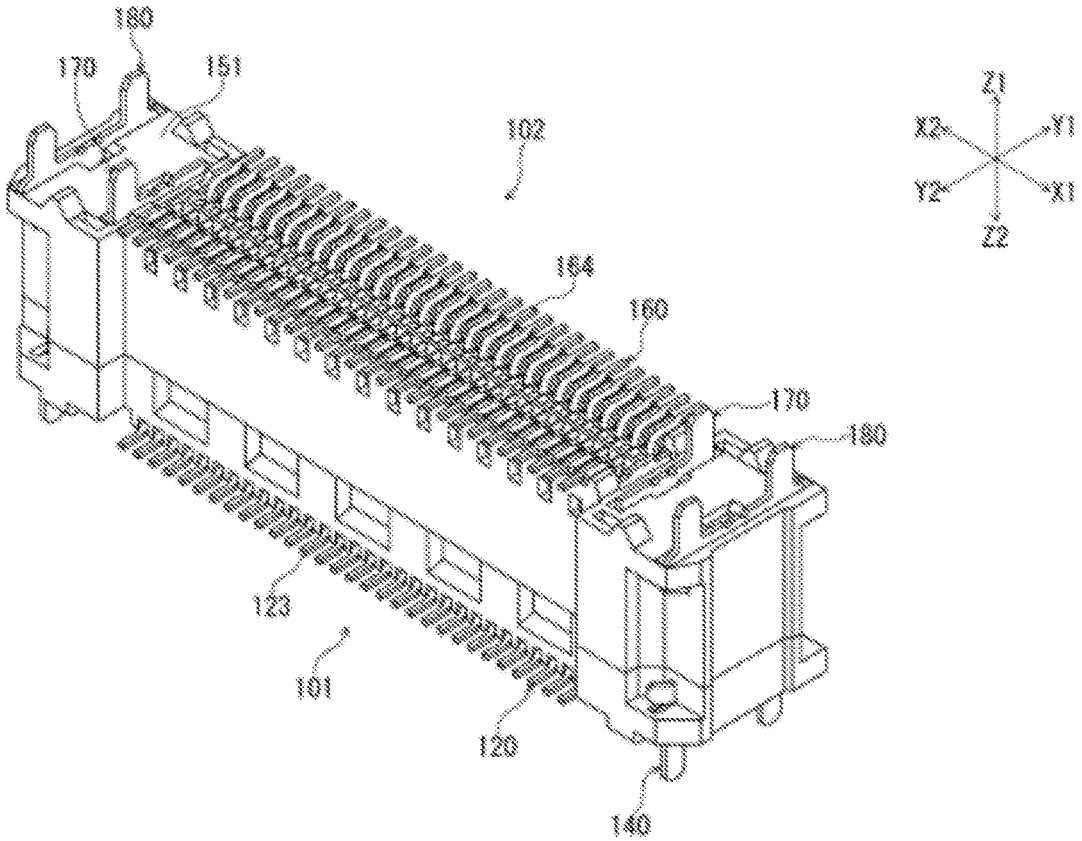
FIG. 10 illustrates a perspective view illustrating the electrical connector and counterpart connector of FIG. 9 in a mated state.

FIG. 9 is a perspective view illustrating an electrical connector and a counterpart connector according to the second embodiment, in which the connectors are in an unmated state. FIG. 10 is a perspective view illustrating the electrical connector and counterpart connector of FIG. 9 in a mated state.

The electrical connector assembly according to the present embodiment, which is used for the transmission of high-speed signals, has an electrical connector 101 (hereinafter referred to as "connector 101") used as the first electrical connector, and a counterpart connector 102 used as a second electrical connector mated to said electrical connector 101 from above. The connector 101 and counterpart connector 102 are electrical connectors for circuit boards disposed on respectively different circuit boards (not shown), which are mated to each other while being oriented such that the surfaces of the respective circuit boards are perpendicular to the up-down direction (Z-axis direction).

The connector 101, which is formed as a plug connector, has a plastic housing 110 serving as a terminal holder, multiple metal signal terminals 120 serving as first terminals arranged in a terminal array direction coinciding with the X-axis direction and retained in place in said housing 110, and inner fittings 130 along with outer fittings 140 retained in place in the housing 110 on both sides of the terminal array range in the terminal array direction.

The housing 110 has a base portion 111, which extends parallel to the mounting face of the circuit board, and mating portions 112 rising from said base portion 111 and extending in the terminal array direction (X-axis direction). The base portion 111, which is of a substantially rectangular parallelepiped-like external configuration whose longitudinal direction is the terminal array direction (X-axis direction) when viewed in the up-down direction (Z-axis direction), has two lateral base portions 111A, which extend in the terminal array direction, two end base portions 111B, which extend in the connector width direction (Y-axis direction), i.e., in the transverse direction of the base portion 111, and which couple the two ends of the two lateral base portions 111A, and coupling base portions 111C, which extend between the two lateral base portions 111A in the terminal array direction (X-axis direction) and couple the two interior wall surfaces of the two end base portions 111B (see FIG. 12 (A)). In addition, an aperture portion 111D passing in the up-down direction is formed between the lateral base portions 111A and coupling base portions 111C.

The mating portions 112 rise from the top face of the base portion 111 and have a square frame configuration, whose longitudinal direction is the terminal array direction (X-axis direction) when viewed in the up-down direction (Z-axis direction). Said mating portions 112 have two lateral walls 112A, which extend in the terminal array direction, and two end walls 112B, which extend in the connector width direction and couple the two ends of the two lateral walls 112A. The space enclosed by the lateral walls 112A and end walls 112B of said mating portions 112, which passes in the up-down direction and is in communication with the aperture portion 111D of the base portion 111, forms a receiving portion 112C receiving the protruding wall 153 of the counterpart connector 102 from above when the connectors are in a mated state.

Figure 12:
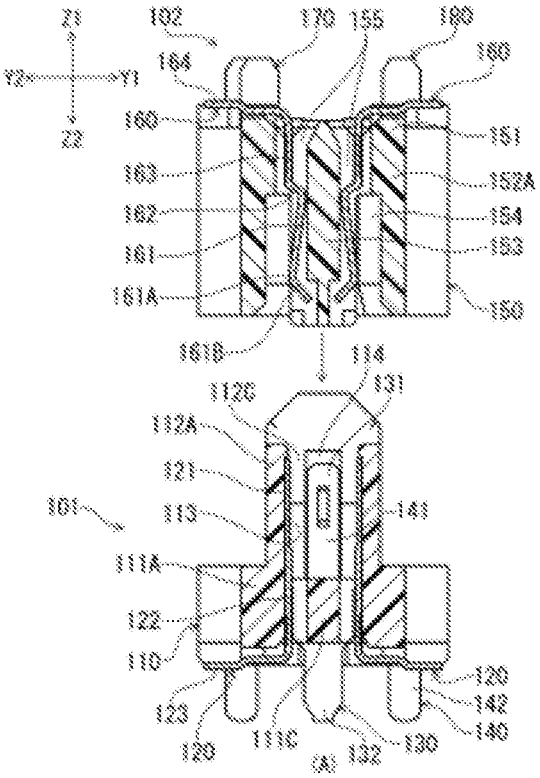
FIGS. 12 (A) and 12 (B) illustrate partial cross-sectional views taken at the location of the signal terminals of the electrical connector and a counterpart connector in the connector width direction, wherein FIG. 12 (A) illustrates a state prior to connector mating, and FIG. 12 (B) illustrates the connectors in a mated state.
Figure 12:
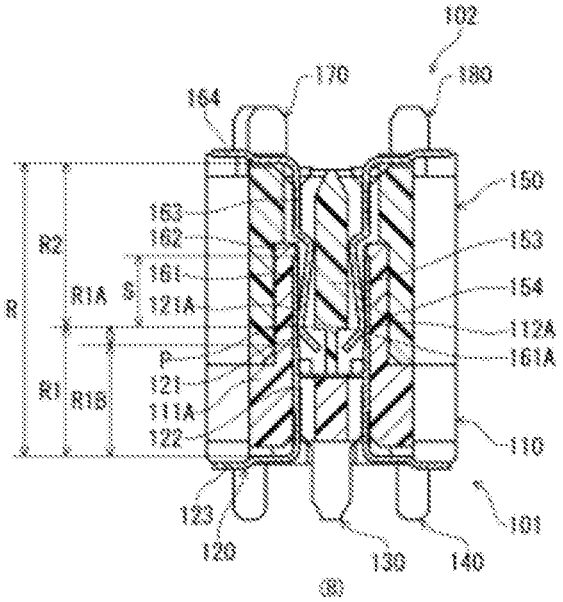

As can be seen in FIGS. 12 (A) and 12 (B), in the housing 110, vertically extending terminal holding groove portions 113 are formed in the up-down direction along inner lateral faces of the lateral walls 112A and the inner lateral faces of the lateral base portions 111A (faces perpendicular to the Y-axis direction). In addition, as can be seen in FIG. 9, inner fitting holding portions 114 used to secure the inner fittings 130 in place via press-fitting and outer fitting holding portions 115 used to secure the outer fittings 140 in place via press-fitting are formed on both sides of the terminal array range in the terminal array direction. The outer fitting holding portions 115 are formed outwardly of the inner fitting holding portions 114 in the terminal array direction. The inner fitting holding portions 114 and outer fitting holding portions 115 extend in the connector width direction (Y-axis direction) and in the up-down direction (Z-axis direction) while being formed through the end base portions 111B and end walls 112B of the housing 110 in the up-down direction. As can be seen in FIG. 9, the top portions of the inner fitting holding portions 114 form recesses in the inner lateral faces of the end walls 112B, and the top portions of the outer fitting holding portions 115 form recesses in the outer lateral faces of the end walls 112B.

Figure 11:
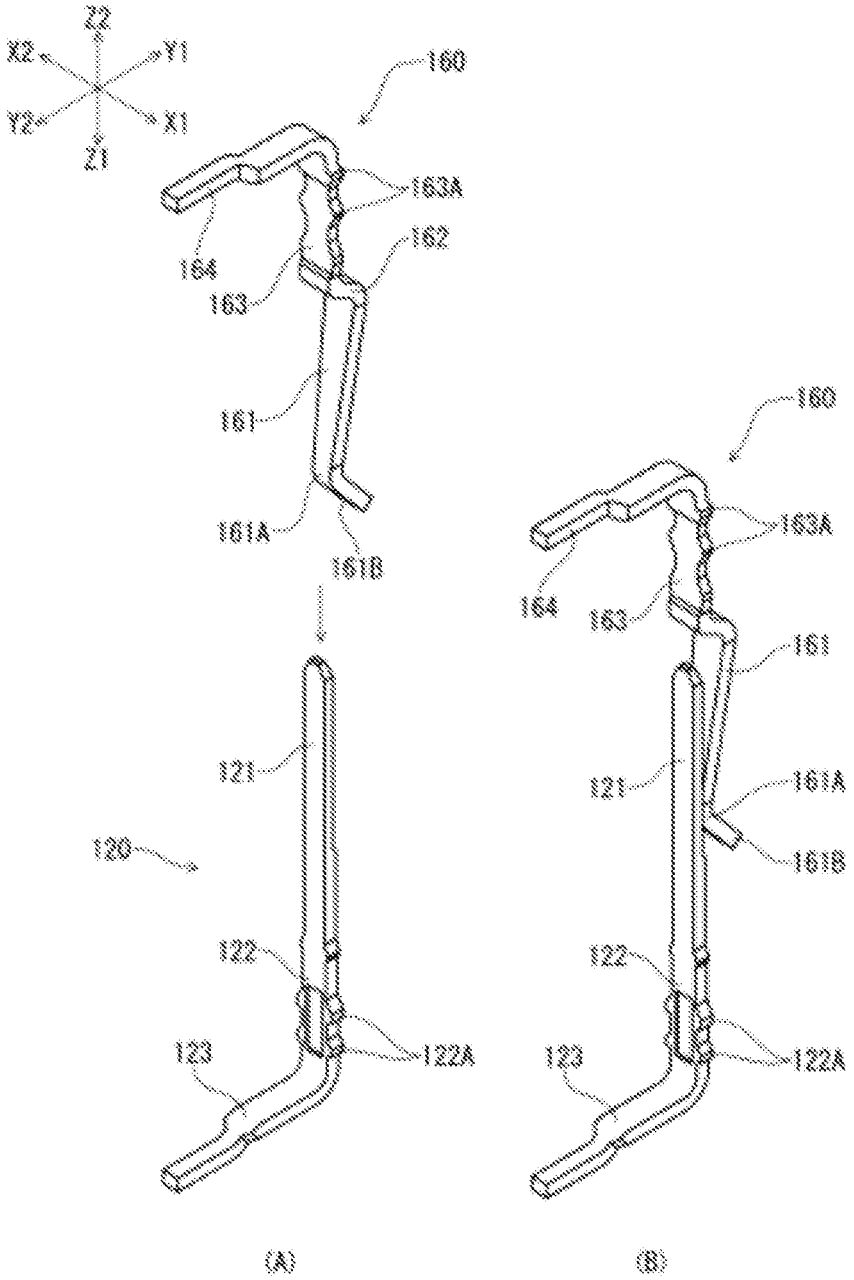
FIGS. 11 (A) and 11 (B) illustrate perspective views showing single terminals removed, respectively, from the electrical connector and a counterpart connector, wherein FIG. 11 (A) illustrates a state prior to connector mating, and FIG. 11 (B) illustrates the connectors in a mated state.

As can be seen in FIG. 9, in the present embodiment, two rows of signal terminals 120 arranged in the terminal array direction are retained in the housing 110 symmetrically in the connector width direction (see also FIGS. 12 (A) and 12 (B)). FIG. 11 provides perspective views of a single signal terminal 120 contained in the terminal row on side Y2 and a counterpart signal terminal 160 removed, respectively, from the connector 101 and the counterpart connector 102, wherein (A) illustrates a state prior to connector mating and (B) illustrates the connectors in a mated state. As can be seen in FIGS. 11 (A) and 11 (B), the signal terminal 120, which is fabricated by bending a strip-shaped sheet metal member in the through-thickness direction, has a vertically extending contact arm portion 121, a retained portion 122 extending downwardly from the lower end of said contact arm portion 121, and a connecting portion 123, which is obtained by bending the lower end of said retained portion 122 in the connector width direction (Y-axis direction) and extends toward side Y2. Said signal terminal 120 is attached to said housing 110 by press-fitting into a terminal holding groove portion 113 from underneath the housing 110 (see FIG. 12 (A)).

As can be seen in FIGS. 11 (A) and 11 (B), the contact arm portion 121, which is oriented such that its major faces (rolled faces) are at right angles to the connector width direction (Y-axis direction), extends in the up-down direction through the terminal holding groove portion 113 (see FIG. 12 (A)) along the lateral wall 112A. Said contact arm portion 121, whose through-thickness dimensions (dimensions in the Y-axis direction) in the top half are smaller than its through-thickness dimensions in the bottom half, can be brought into contact with a counterpart signal terminal 160 via its major face on side Y1 in the top half thereof, i.e., its major face exposed in the receiving portion 112C of the housing 110.

It is to be noted that despite the fact that in the present embodiment the contact arm portions 121 of the signal terminals 120 are not intended to be resiliently displaced, it is not essential for these portions to be incapable of resilient displacement and they may be formed in a manner permitting resilient displacement in their through-thickness direction.

The retained portion 122, which is oriented such that its major faces (rolled faces) are at right angles to the connector width direction (Y-axis direction), extends in the up-down direction through the terminal holding groove portion 113 (see FIG. 12 (A)) along the lateral base portion 111A. Two press-fitting protrusions 122A protruding in the terminal array direction are formed on each of the two lateral edges of said retained portion 122. The press-fitting protrusions 122A of the retained portion 122 bite into the interior wall surface of the terminal holding groove portion 113, thereby retaining it in place within said terminal holding groove portion 113.

As can be seen in FIGS. 11 (A) and 11 (B), the connecting portion 123 extends outwardly in the connector width direction and, as can be seen in FIG. 9 and FIG. 12 (A), its distal end section projects outside the housing 110 from the bottom of the lateral base portion 111A of the housing 110. Said connecting portions 123 are adapted to have their bottom faces solder-connected to corresponding circuits on the mounting face of the circuit board (not shown).

The inner fittings 130, which are fabricated by bending a sheet metal member in the through-thickness direction and are oriented such that their major faces (rolled faces) are at right angles to the terminal array direction (X-axis direction), are retained in the housing 110 on both sides of the terminal array range. Said inner fittings 130 have a retained portion (not shown), which is retained in place by the end base portions 111B of the housing 110, an inner end plate portion 131, which extends upwardly from said retained portion, and an inner securing portion 132, which extends downwardly from said retained portion.

The above-mentioned retained portions are secured in place via press-fitting in inner fitting holding portions 114 formed in the end base portions 111B of the housing 110. The major faces (rolled faces) of the sections of the inner end plate portions 131, which extend along the inner lateral faces of the end walls 112B of the housing 110 in the up-down direction and are contained within the inner fitting holding portions 114, are exposed on said end walls 112B (see FIG. 12 (A)). The inner securing portions 132, which project downwardly from the bottom faces of the end base portions 111B, are inserted into corresponding aperture portions formed in the circuit board (not shown) and, in this state, secured to said circuit board by solder connection.

The outer fittings 140, which are fabricated by bending a sheet metal member in the through-thickness direction and are oriented such that their major faces (rolled faces) are at right angles to the terminal array direction (X-axis direction), are retained in the housing 110 at more outwardly positions in the terminal array direction than the inner fittings 130. Said outer fittings 140 have a retained portion (not shown), which is retained in place by the end base portions 111B of the housing 110, an outer end plate portion 141, which extends upwardly from said retained portion, and an outer securing portion 142, which extends downwardly from said retained portion.

The above-mentioned retained portions are secured in place via press-fitting in outer fitting holding portions 115 formed in the end base portions 111B of the housing 110. The major faces (rolled faces) of the sections of the outer end plate portions 141, which extend along the outer lateral faces of the end walls 112B of the housing 110 in the up-down direction and are contained within the outer fitting holding portions 115, are exposed on said end walls 112B. The outer securing portions 142, which project downwardly from the bottom faces of the end base portions 111B, are inserted into corresponding aperture portions formed in the circuit board (not shown) and, in this state, secured to said circuit board by solder connection.

As can be seen in FIG. 9, FIG. 10 and FIGS. 12 (A) and 12 (B), the counterpart connector 102, which is formed as a receptacle connector, has a plastic housing 150 serving as a terminal holder, multiple metal counterpart signal terminals 160 serving as second terminals arranged in a terminal array direction coinciding with the X-axis direction and retained in place in said housing 150, and inner fittings 170 along with outer fittings 180 retained in the housing 150 on both sides of the terminal array range in the terminal array direction.

As can be seen in FIG. 9, FIG. 10 and FIGS. 12 (A) and 12 (B), the housing 150 has a bottom wall 151, which extends parallel to the mounting face of the circuit board, as well as a protruding wall 153 and perimeter walls 152, which extend downwardly from the perimeter edge portion of said bottom wall 151. The perimeter walls 152, which serve as a corresponding mating portion mated with the mating portion 112 of the connector 101 and have a square frame configuration whose longitudinal direction coincides with the terminal array direction (X-axis direction) when viewed from below, include two lateral walls 152A, which extend in the terminal array direction, and two end walls 152B, which extend in the connector width direction, i.e., in a direction transverse of said perimeter walls 152, and which couple the two ends of the two lateral walls 152A. The protruding wall 153 extends in the terminal array direction within the space enclosed by the above-mentioned perimeter walls 152 (see FIG. 12 (A)). The downwardly open annular space formed between the perimeter walls 152 and the protruding wall 153 forms a receiving portion 154, which is intended to receive the mating portion 112 of the connector 101 (see FIG. 12 (A)).

As can be seen in FIGS. 12 (A) and 12 (B), the housing 150 has formed therein terminal holding portions 155, which extend in the up-down direction along both lateral faces (faces perpendicular to the Y-axis direction) of the protruding wall 153 and pass through the bottom wall 151 in the up-down direction. In addition, as can be seen in FIG. 9, inner fitting retaining portions 156 used to secure the inner fittings 170 in place via press-fitting and outer fitting retaining portions 157 used to secure the outer fittings 180 in place via press-fitting are formed on both sides of the terminal array range in the terminal array direction. The outer fitting retaining portions 157 are formed outwardly of the inner fitting retaining portions 156 in the terminal array direction. The inner fitting retaining portions 156 and outer fitting retaining portions 157 extend in the connector width direction (Y-axis direction) and in the up-down direction (Z-axis direction) while being formed through the end walls 152B and bottom walls 151 of the housing 150 in the up-down direction.

As can be seen in FIGS. 12 (A) and 12 (B), in the present embodiment, two rows of counterpart signal terminals 160 arranged in the terminal array direction are retained in the housing 150 symmetrically in the connector width direction. As can be seen in FIGS. 11 (A) and 11 (B), the counterpart signal terminals 160, which are fabricated by bending a strip-shaped sheet metal member in the through-thickness direction, have a resilient arm portion 161, which extends in the up-down direction and is resiliently displaceable in the connector width direction (Y-axis direction), a transitional portion 162, which is bent at the upper end of said resilient arm portion 161 in a crank-like configuration, a retained portion 163, which extends upwardly from said transitional portion 162, and a connecting portion 164, which is bent at the upper end of said retained portion 163 and extends in the connector width direction (Y-axis direction) toward side Y2. As can be seen in FIG. 12 (A), the counterpart signal terminals 160 are attached to the housing 150 by press-fitting from above said housing 150 into the terminal holding portions 155.

As can be seen in FIGS. 11 (A) and 11 (B), the resilient arm portion 161, which is oriented such that its major faces (rolled faces) are at right angles to the connector width direction (Y-axis direction), extends in the up-down direction through the terminal holding portion 155 (see FIG. 12 (A)). As can be seen in FIGS. 11 (A) and 11 (B), said resilient arm portion 161 has formed therein a convex contact point portion 161A protruding outwardly in the connector width direction (side Y2 in FIGS. 11 (A) and 11 (B)) at a location proximal to its lower end and, when the resilient arm portion 161 is in a state of resilient displacement, is adapted to contact a contact arm portion 121 of a signal terminal 120 of the connector 101 with the above-mentioned convex contact point portion 161A (see FIG. 12 (B)). In addition, a guiding portion 161B used to guide the signal terminal 120 of the connector 101 in the connector width direction toward the regular location of contact is formed within the range located closer to the free end, i.e., to the lower end thereof in the up-down direction, than the protruding apex portion of the convex contact point portion 161A.

It should be noted that, similar to the first embodiment, being capable of resilient displacement is not an essential feature of the section of the counterpart signal terminals 160 in which the convex contact point portion 161A is formed. Therefore, for example, vertically extending contact arm portions not capable of resilient displacement may be provided in the counterpart signal terminals 160 instead of the above-mentioned resilient arm portions 161, and convex contact point portions may be formed in said contact arm portions.

The retained portion 163, which is located outwardly of the resilient arm portion 161 in the connector width direction and is oriented such that the major faces (rolled faces) of said retained portion 163 are at right angles to the connector width direction, extends in the up-down direction through the terminal holding portion 155 (see FIG. 12 (A)). As can be seen in FIG. 11 (A, B), two press-fitting protrusions 163A protruding in the terminal array direction are formed on each of the two lateral edges of said retained portion 163. The press-fitting protrusions 163A of the retained portion 163 bite into the interior wall surface of the terminal holding portion 155, thereby retaining it in place within said terminal holding portion 155.

As can be seen in FIG. 9 and FIG. 12 (A), the connecting portions 164 extend outwardly in the connector width direction and their distal end sections project outside the housing 150 from the top of the bottom wall 151 of the housing 150. Said connecting portions 164 are adapted to have their top faces solder-connected to corresponding circuits on the mounting face of the circuit board (not shown).

The inner fittings 170, which are made from sheet metal members and are oriented such that their major faces (rolled faces) are at right angles to the terminal array direction, are retained in place in the housing 150. As can be seen in FIG. 9, said inner fittings 170, which have a retained portion (not shown) retained in place in the housing 150 and a single inner securing portion 171 extending upwardly from said retained portion, are attached to the inner fitting retaining portions 156 of the housing 150 from above by press-fitting. The inner securing portions 171 of said inner fittings 170, which project upwardly from the bottom face (top face in FIG. 9) of the bottom wall 151 of the housing 150, are inserted into the corresponding aperture portions formed in the circuit board (not shown) and, in this state, are secured to said circuit board by solder connection.

The outer fittings 180, which are made from sheet metal members and are oriented such that their major faces (rolled faces) are at right angles to the terminal array direction, in other words, parallel to the major faces of the inner fittings, are retained in place in the housing 150. As can be seen in FIG. 9, said outer fittings 180, which have a retained portion (not shown) retained in place in the housing 150 and two outer securing portions 181 extending upwardly from said retained portion, are attached to the outer fitting retaining portions 157 of the housing 150 from above by press-fitting. The outer securing portions 181 of said outer fittings 180, which project upwardly from the bottom face (top face in FIG. 9) of the bottom wall 151 of the housing 150, are inserted into corresponding aperture portions formed in the circuit board (not shown) and, in this state, are secured to said circuit board by solder connection.

Next, the operation of connector mating will be described with reference to FIG. 9 and FIG. 12. FIG. 12 provides partial cross-sectional views taken at the location of the signal terminals 120 and counterpart signal terminals 160 of the connector 101 and counterpart connector 102 in the connector width direction, wherein FIG. 12 (A) illustrates a state prior to connector mating, and FIG. 12 (B) illustrates the connectors in a mated state.

First, the connector 101 and counterpart connector 102 are solder-connected to the respectively corresponding circuits of the circuit boards and, as shown in FIG. 9 and FIG. 12 (A), the counterpart connector 102 is positioned above the connector 101 with the receiving portion 154 of said counterpart connector 102 oriented in the downward direction. The connector 101 and counterpart connector 102 are then mated by lowering the counterpart connector 102 (see FIG. 10 and FIG. 12 (B)).

In the process of connector mating, as the mating portion 112 of the connector 101 enters the receiving portion 154 of the counterpart connector 102 from below, the protruding wall 153 of the counterpart connector 102 enters the receiving portion 112C of the mating portion 112 of the connector 101 from above (see FIG. 12 (B)). In this process of connector mating, the convex contact point portion 161A of the counterpart signal terminals 160 abuts the contact arm portion 121 of the signal terminals 120, thereby resiliently displacing the resilient arm portion 161 of the counterpart signal terminals 160 inwardly in the connector width direction. As can be seen in FIG. 12 (B), once the connectors are mated and the resilient arm portions 161 are in a state of resilient displacement, convex contact point portions 161A of the counterpart signal terminals 160 are brought into contact with and electrically connected to the intermediate portions in the up-down direction of the contact arm portions 121 of the signal terminals 120. As can be seen in FIG. 12 (B), when the connectors are in a mated state, the section extending from the location of contact with the convex contact point portions 161A of the counterpart signal terminals 160 in the contact arm portions 121 of the signal terminals 120 to the upper end portion of the contact arm portions 121 is formed as a stub portion 121A. In FIG. 12 (B), the vertical range of the stub portion 121A is designated as "S".

As can be seen in FIG. 12 (B), in the present embodiment, once the connectors are mated, a main transmission path used to transmit high-speed signals is formed by the sections other than the stub portion 121A of the signal terminals 120 of the connector 101 and the sections other than the guiding portion 161B of the counterpart signal terminals 160 of the counterpart connector 102.

In FIG. 12 (B), a predetermined range within the above-mentioned main transmission path that includes the location of contact P between the contact arm portion 121 of the signal terminals 120 and the convex contact point portion 161A of the counterpart signal terminals 160 is designated as "R". Specifically, the predetermined range R is a vertical range extending between the upper end of the retained portions 163 of the counterpart signal terminals 160 provided in the counterpart connector 102 and the lower end of the retained portions 122 of the signal terminals 120 provided in the connector 101. In addition, in FIG. 12 (B), this predetermined range R is split into a first range R1 located below the location of contact P and a second range R2 located above the location of contact P such that said location of contact P forms a boundary therebetween in the up-down direction. Further, the above-mentioned first range R1 is split in the up-down direction into a first upper range R1A, which extends from the location of contact P to the lower end of the contact arm portion 121 of the signal terminals 120, and a first lower range R1B, which extends from the lower end of said contact arm portion 121 to the lower end of the retained portion 122.

The bottom portion of the contact arm portion 121 of the signal terminals 120 is located in the first upper range R1A within the first range R1, and the impedance of the first upper range R1A is substantially equal to the impedance of the range (stub range) S of the stub portion 121A.

The retained portions 122 of the signal terminals 120 are located in the first lower range R1B within the first range R1. In comparison with the stub portions 121A, which form part of the contact arm portions 121, said retained portions 122 are formed to be larger in the through-thickness direction (X-axis direction). In addition, most of the retained portion 122 is covered by the base portion 111 of the plastic housing 110 around the entire circumference of said retained portion 122. Therefore, the impedance of the first lower range R1B is smaller than the impedance of the range (stub range) S of the stub portion 121A.

In addition, the resilient arm portions 161, transitional portions 162, and retained portions 163 of the counterpart signal terminals 160 are located in the second range R2. In comparison with the stub portions 121A, which form part of the contact arm portions 121 of the signal terminals 120, said resilient arm portions 161, transitional portions 162, and retained portions 163 are formed to be larger in the through-thickness direction (X-axis direction). In addition, the retained portions 163 are covered by the bottom wall 151 of the plastic housing 150 around the entire periphery of said retained portions 163. Therefore, the impedance of the second range R2 is smaller than the impedance of the range (stub range) S of the stub portion 121A.

As discussed above, in the present embodiment, the impedance of the first lower range R1B located below the above-mentioned location of contact P and the second range R2 located above the above-mentioned location of contact P within the above-mentioned predetermined range R is smaller than the impedance of the stub range S. Making the impedance of most of the above-mentioned predetermined range R smaller than impedance of the stub range S in this manner makes is possible to minimize signal reflection and, therefore, degradation in signal transmission quality due to the presence of the stub portions 121A and even if the frequency of the signals transmitted over the above-mentioned main transmission path is within the range of frequencies in the vicinity of the resonance frequency.

Although in the present embodiment, as discussed above, the impedance of the first upper range R1A is equal to the impedance of the range (stub range) S of the stub portion 121A, for example, if a mating depth position is set, as the regular location of contact, such that the above-mentioned location of contact P in the contact arm portions 121 of the signal terminals 120 is closer to the retained portion 122 and the first upper range R1A is made smaller in the up-down direction, the range within the above-mentioned predetermined range R, in which impedance in the stub range S is smaller can be increased and, as a result, signal reflection and, therefore, degradation in signal transmission quality can be more effectively minimized.

In addition, in order to more effectively minimize degradation in signal transmission quality, just like in the first embodiment, it is preferable that the electrical length of the section corresponding to the above-mentioned predetermined range R be approximately 3 to $4L_0$ if the electrical length of the above-mentioned stub portion 121A is $L_0$ and, in addition, that the electrical length of the first range R1 in the signal terminals 120 of the connector 101 be equal to the electrical length of the second range R2 in the counterpart signal terminals 160 of the counterpart connector 102.

DESCRIPTION OF THE REFERENCE NUMERALS

1 Intermediate connector (first connector)
2 Counterpart connector (second connector)
3 Counterpart connector (second connector)
21 Substrate (terminal holder)
22 Signal terminals (first terminals)
22A Upper contact arm portion (contact arm portion)
22A-1 Stub portion
22B Lower contact arm portion (contact arm portion)
31 Holder (terminal holder)
40 Counterpart signal terminals (second terminals)
41A Convex signal contact point portion (convex contact point portion)
41B Guiding portion

101 Connector (first connector)
102 Counterpart connector (second connector)
110 Housing (terminal holder)
120 Signal terminals (first terminals)
121 Contact arm portion
121A Stub portion
150 Housing (terminal holder)
160 Counterpart signal terminals (second terminals)
161A Convex contact point portion
161B Guiding portion
P Location of contact
R Predetermined range

The invention claimed is:

1. An electrical connector assembly comprising:

a first electrical connector and a second electrical connector mated in a manner permitting plugging into and unplugging from each other, wherein the first electrical connector has multiple first terminals used for signal transmission arranged such that a direction perpendicular to the direction of plugging into and unplugging from the second electrical connector is the terminal array direction;

said first terminals, in their free end portions located on the connector mating side, have contact arm portions extending in the direction of plugging and unplugging;

the second electrical connector has multiple second terminals used for signal transmission arranged in the same direction as the terminal array direction;

said second terminals, in their free end portions located on the connector mating side, have convex contact point portions contactable with intermediate portions of the contact arm portions of the first terminals in the direction of plugging and unplugging;

a section of the contact arm portions of the first terminals that extends from the location of contact with the convex contact point portions of the second terminals to the free end portion of said contact arm portions in the direction of plugging and unplugging forms a stub portion; the sections of the first terminals other than the stub portion and the second terminals constitute a main transmission path; and, within a predetermined range of an electrical length within the main transmission path inclusive of the location of contact in the main transmission path of the first terminals and the second terminals, the impedance of at least a partial range of an electrical length from the location of contact in the main transmission path of one or more of the first terminals and the second terminals of said predetermined range is made smaller than the impedance of the stub portion.

2. The electrical connector assembly according to claim 1, wherein the electrical length of the section corresponding to the predetermined range in the main transmission path is $4L_0$ if the electrical length of the stub portion is $L_0$.

3. The electrical connector assembly according to claim 1 wherein the section corresponding to the predetermined range in the main transmission path is adapted such that the electrical length of the section formed in the first terminals and the electrical length of the section formed in the second terminals are equal.

4. The electrical connector assembly according to claim 1 wherein the terminal array direction dimensions of the section corresponding to the predetermined range in the main transmission path are larger than the dimensions of the stub portion in the same direction.

5. The electrical connector assembly according to claim 1, wherein the dimensions of the section corresponding to the predetermined range in the main transmission path in a direction perpendicular to both the terminal array direction and the direction of plugging and unplugging are larger than the dimensions of the stub portion in the same direction.

6. The electrical connector assembly according to claim 1, wherein the first terminals and second terminals are respectively retained in place by a plastic terminal holder and at least a portion of the section corresponding to the predetermined range in the main transmission path in the direction of plugging and unplugging is covered by a portion of the terminal holder.

7. The electrical connector assembly according to claim 6, wherein the convex contact point portions of the second terminals are shaped to protrude toward the contact arm portions of the first terminals, a guiding portion used for guiding the contact arm portions of the first terminals toward the location of contact is formed within the range of the free ends of the second terminals, and the terminal holder of the first connector covers the first terminals at the location corresponding to the guiding portion in the direction of plugging and unplugging when the connectors are in a mated state.

* * * * *